US011410612B2

(12) United States Patent
Jeong et al.

(10) Patent No.: US 11,410,612 B2
(45) Date of Patent: Aug. 9, 2022

(54) DRIVING CIRCUIT AND DISPLAY DEVICE HAVING THE SAME

(71) Applicant: Samsung Display Co., Ltd., Yongin-Si (KR)

(72) Inventors: Junki Jeong, Yongin-si (KR); Gyungsoon Park, Seoul (KR); Seon Young Choi, Gunpo-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/363,559

(22) Filed: Jun. 30, 2021

(65) Prior Publication Data

US 2022/0139324 A1 May 5, 2022

(30) Foreign Application Priority Data

Nov. 3, 2020 (KR) ..... 10-2020-0145488

(51) Int. Cl.
*G09G 3/3266* (2016.01)
*G09G 3/3275* (2016.01)

(52) U.S. Cl.
CPC ..... *G09G 3/3266* (2013.01); *G09G 3/3275* (2013.01); *G09G 2310/0278* (2013.01)

(58) Field of Classification Search
None
See application file for complete search history.

(56) References Cited

U.S. PATENT DOCUMENTS

| | | | | |
|---|---|---|---|---|
| 10,198,998 | B2 * | 2/2019 | In | G09G 3/3266 |
| 10,615,172 | B2 * | 4/2020 | Nagata | H01L 27/11556 |
| 10,665,172 | B2 | 5/2020 | Lee et al. | |
| 2010/0295837 | A1 * | 11/2010 | Yoshinaga | G09G 3/3677 345/211 |
| 2016/0217728 | A1 * | 7/2016 | In | G09G 3/2096 |
| 2016/0217763 | A1 * | 7/2016 | Toyoda | G09G 3/3674 |
| 2016/0372022 | A1 * | 12/2016 | Maruyama | G09G 3/3685 |

FOREIGN PATENT DOCUMENTS

KR 1020180057101 A 5/2018

* cited by examiner

*Primary Examiner* — Christopher J Kohlman
(74) *Attorney, Agent, or Firm* — Cantor Colburn LLP

(57) ABSTRACT

A driving circuit includes: a plurality of scan stages each corresponds to a plurality of scan lines, receives clock signals and a carry signal, and outputs a scan signal; and a plurality of masking circuits corresponding to some scan stages, respectively, among the scan stages. each masking circuit outputs one of the scan signal output from a corresponding scan stage and a first voltage as a masking carry signal in response to a masking signal. A j-th scan stage receives a scan signal output from a (j−a)th scan stage as the carry signal when the (j−a)th scan stage is not one of the some first scan stages, and the masking carry signal output from a masking circuit corresponding to the (j−a)th scan stage as the carry signal when the (j−a)th scan stage is one of the some first scan stages.

20 Claims, 17 Drawing Sheets

DRIVING CIRCUIT AND DISPLAY DEVICE HAVING THE SAME

This application claims priority to Korean Patent Application No. 10-2020-0145488, filed on Nov. 3, 2020, and all the benefits accruing therefrom under 35 U.S.C. § 119, the content of which in its entirety is herein incorporated by reference.

BACKGROUND

1. Field of Disclosure

The present disclosure relates to a display device.

2. Description of the Related Art

Among display devices, an organic light emitting display device displays an image using an organic light emitting diode that generates a light from electron-hole recombination. The organic light emitting display device has advantages, such as fast response speed and low power consumption.

The organic light emitting display device includes data lines, scan lines, and pixels connected to the data lines and the scan lines. Each pixel includes the organic light emitting diode and a circuit unit that controls an amount of current flowing through the organic light emitting diode. The circuit unit controls the amount of current flowing from a first driving voltage to a second driving voltage via the organic light emitting diode in response to a data signal. In this case, a light with a predetermined luminance is generated corresponding to the amount of current flowing through the organic light emitting diode.

As the fields of use of the display device are diversified, a plurality of different images is simultaneously displayed on a single display device. Accordingly, a technology capable of reducing power consumption of the display device displaying the plural images becomes desirable.

SUMMARY

The present disclosure provides a driving circuit capable of reducing a power consumption.

The present disclosure provides a display device including the driving circuit.

Embodiments of the inventive concept provide a driving circuit including: a plurality of scan stages each of which corresponds to a plurality of scan lines, receives clock signals and a carry signal, and outputs a scan signal; and a plurality of masking circuits corresponding to some scan stages, respectively, among the plurality of scan stages. Each of the plurality of masking circuits outputs through a carry output terminal one of i) the scan signal output from a corresponding scan stage and ii) a first voltage as a masking carry signal in response to a masking signal. A j-th (j is a natural number greater than 1) scan stage among the plurality of scan stages i) receives a scan signal output from a (j−a)th (a is a natural number less than j) scan stage as the carry signal when the (j−a)th scan stage is not one of the some scan stages, and ii) receives the masking carry signal output from a masking circuit corresponding to the (j−a)th scan stage as the carry signal when the (j−a)th scan stage is one of the some scan stages.

The masking signal may include a first masking signal and a second masking signal.

Each of the masking circuits may output the scan signal output from the corresponding scan stage as the masking carry signal when the first masking signal has a first level and the second masking signal has a second level, and each of the masking circuits may not output the scan signal output from the corresponding scan stage as the masking carry signal when the first masking signal has the second level and the second masking signal has the first level.

Each of the masking circuits may maintain the first voltage as the masking carry signal when the first masking signal has a second level and the second masking signal has a first level.

Each of the scan stages may include an output terminal which outputs the scan signal and a first voltage terminal which receives a first voltage, and the masking circuit may include a first transistor connected between the output terminal of the corresponding scan stage and the carry output terminal and including a gate electrode connected to a first masking input terminal which receives the first masking signal and a second transistor connected between the carry output terminal and the first voltage terminal of the corresponding scan stage and including a gate electrode connected to a second masking input terminal which receives the second masking signal.

Embodiments of the inventive concept provide a display device including a display panel including a plurality of data lines, a plurality of first scan lines, and a plurality of pixels connected to the data lines and the first scan lines; a data driving circuit which drives the data lines; a driving circuit including a first scan driving circuit which drives the first scan lines; and a driving controller which controls the data driving circuit and the driving circuit to drive a first display area of the display panel at a first driving frequency during a multi-frequency mode and to drive a second display area of the display panel at a second driving frequency during the multi-frequency mode. The first scan driving circuit includes a plurality of first scan stages each of which corresponds to the first scan lines, receives clock signals and a carry signal, and outputs a first scan signal. The driving circuit further includes a plurality of masking circuits corresponding to some first scan stages, respectively, among the first scan stages. Each of the masking circuits outputs through a carry output terminal one of i) the first scan signal output from a corresponding first scan stage and ii) a first voltage as a masking carry signal in response to a masking signal. A j-th (j is a natural number greater than 1) first scan stage among the first scan stages i) receives a first scan signal output from a (j−a)th (a is a natural number less than j) first scan stage as the carry signal when the (j−a)th scan stage is not one of the some scan stages, and ii) receives the masking carry signal output from a masking circuit corresponding to the (j−a)th scan stage as the carry signal when the (j−a)th scan stage is one of the some scan stages.

The masking circuit may correspond to a y-th (y is a natural number) first scan stage among the first scan stages and output the first scan signal output from the y-th first scan stage as a y-th carry signal in response to the masking signal, and a (y+a)th first scan stage among the first scan stages may receive the y-th carry signal output from the masking circuit as the carry signal.

The masking signal may include a first masking signal and a second masking signal.

Each of the masking circuits may output the first scan signal output from the corresponding first scan stage as the masking carry signal when the first masking signal has a first level and the second masking signal has a second level, and each of the masking circuits may not output the first scan signal output from the corresponding first scan stage as the masking carry signal when the first masking signal has the second level and the second masking signal has the first level.

Each of the masking circuits may maintain the first voltage as the masking carry signal when the first masking signal has the second level and the second masking signal has the first level.

Each of the first scan stages may include an output terminal which outputs the scan signal and a first voltage terminal which receives the first voltage. The masking circuit may include a first transistor connected between the output terminal of the corresponding first scan stage and the carry output terminal and including a gate electrode connected to a first masking input terminal which receives the first masking signal, and a second transistor connected between the carry output terminal and the first voltage terminal of the corresponding first scan stage and including a gate electrode connected to a second masking input terminal which receives the second masking signal.

The driving controller may control the data driving circuit and the scan driving circuit to drive the first display area and the second display area at a predetermined frequency in a normal-frequency mode, and the second driving frequency may be lower than the predetermined frequency.

The first driving frequency may be higher than the predetermined frequency.

The display panel may further include a plurality of second scan lines connected to the pixels, respectively, and the driving circuit may further include a second scan driving circuit including a plurality of second scan stages each of which corresponds to the second scan lines, receives the clock signals and the carry signal, and outputs a second scan signal.

The display panel may further include a plurality of third scan lines connected to the pixels, respectively, and the driving circuit may further include a third scan driving circuit including a plurality of third scan stages each of which corresponds to the third scan lines, receives the clock signals and the carry signal, and outputs a third scan signal.

The display panel may further include a plurality of light emitting control lines connected to the pixels, respectively, and the driving circuit may further include a light emitting driving circuit including a plurality of light emitting stages each of which corresponds to the light emitting control lines, receives the clock signals and the carry signal, and outputs a light emitting control signal.

The first scan lines, the second scan lines, the third scan lines, and the light emitting control lines may extend in a first direction and be arranged in a second direction to be spaced apart from each other.

Each of the first scan stages, each of the second scan stages, and each of the light emitting stages may have a same length in a second direction, and each of the first scan stages may be two times greater in a length in the second direction than a length in the second direction of each of the third scan stages.

Each of the first scan stages may apply first scan signals that are substantially the same as each other to pixels arranged in four rows among the plurality of pixels, and each of the light emitting stages may apply light emitting control signals that are substantially the same as each other to pixels arranged in four rows among the plurality of pixels.

Each of the second scan stages may apply second scan signals that are substantially the same as each other to pixels arranged in two rows among the plurality of pixels, and each of the third scan stages may apply light emitting control signals that are substantially the same as each other to pixels arranged in one row among the plurality of pixels.

According to the above, when a moving image is displayed in the first display area and a still image is displayed in the second display area, the display device drives the first display area at the first driving frequency and drives the second display area at the second driving frequency in the multi-frequency mode. Since the second driving frequency of the second display area in which the still image is displayed is lowered, a power consumption of the display device is reduced. Particularly, a start position of the second display area is able to be changed in the display device, and thus, the effect of reducing power consumption is improved. In addition, even though the display device further includes the masking circuit to set the start position of the second display area, an increase of the circuit area is minimized.

BRIEF DESCRIPTION OF THE DRAWINGS

The above and other advantages of the present disclosure will become readily apparent by reference to the following detailed description when considered in conjunction with the accompanying drawings wherein.

DETAILED DESCRIPTION

Figure 1:
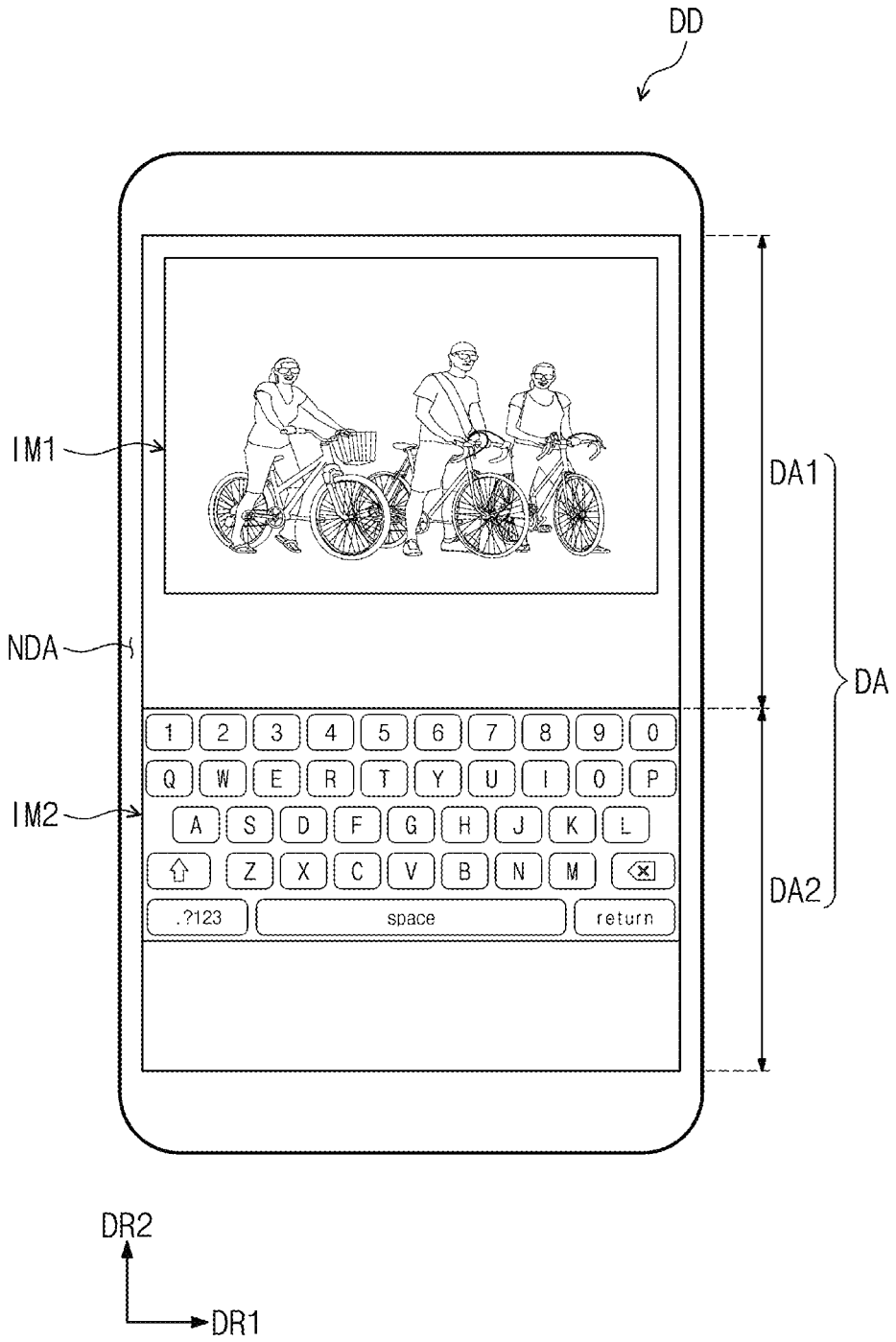
FIG. 1 is a plan view showing a display device according to an embodiment of the present disclosure.

In the present disclosure, it will be understood that when an element or layer is referred to as being "on", "connected to" or "coupled to" another element or layer, it can be directly on, connected or coupled to the other element or layer or intervening elements or layers may be present.

Like numerals refer to like elements throughout. In the drawings, the thickness of layers, films, and regions are exaggerated for clarity. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure. As used herein, the singular forms, "a", "an" and "the" are intended to include the plural forms as well, unless the context clearly indicates otherwise.

Spatially relative terms, such as "beneath", "below", "lower", "above", "upper" and the like, may be used herein for ease of description to describe one element or feature's relationship to another element(s) or feature(s) as illustrated in the figures.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present disclosure will be explained in detail with reference to the accompanying drawings.

FIG. 1 is a plan view showing a display device DD according to an embodiment of the present disclosure.

Referring to FIG. 1, a potable terminal is shown as a representative example of the display device DD according to the embodiment of the present disclosure. The potable terminal may include a tablet PC, a smartphone, a personal digital assistant ("PDA"), a portable multimedia player ("PMP"), a game unit, a wrist-watch type electronic device, or the like, however, the present disclosure according to the invention should not be limited thereto or thereby. The display device DD may be applied to a large-sized display device, such as a television set, an outdoor billboard, or the like, or a small- and medium-sized display device, such as a personal computer, a notebook computer, a kiosk, a car navigation unit, a camera, or the like. However, these are merely examples, and the display device DD may be employed in other electronic items as long as they do not depart from the inventive concept of the present disclosure.

As shown in FIG. 1, a display surface on which a first image IM1 and a second image IM2 are displayed is substantially parallel to a surface defined by a first direction DR1 and a second direction DR2. The display device DD includes a plurality of areas distinguished from each other on the display surface. The display surface includes a display area DA on which the first image IM1 and the second image IM2 are displayed, and a non-display area NDA around the display area DA. The non-display area NDA may be referred to as a bezel area. As an example, the display area DA has a quadrangular shape. The non-display area NDA surrounds the display area DA. In addition, although not shown in figures, the display area DA may have a curved shape in a portion thereof. As a result, the display device DD may have the curved shape in an area thereof.

The display area DA of the display device DD includes a first display area DA1 and a second display area DA2. In a specific application program, the first image IM1 is displayed in the first display area DA1, and the second image IM2 is displayed in the second display area DA2. For example, the first image IM1 may be a moving image, and the second image IM2 may be a still image or text information with a long cycle of change.

The display device DD may drive the first display area DA1 in which the moving image is displayed at a normal frequency and may drive the second display area DA2 in which the still image is displayed at a low frequency lower than the normal frequency. The display device DD may decrease a driving frequency of the second display area DA2, and thus, a power consumption of the display device DD may decrease.

Each of the first display area DA1 and the second display area DA2 may have a predetermined size, and the size of the first display area DA1 and the second display area DA2 may vary according to an application program. In an embodiment, when the still image is displayed in the first display area DA1 and the moving image is displayed in the second display area DA2, the first display area DA1 may be driven at the low frequency, and the second display area DA2 may be driven at the normal frequency. In addition, the display area DA may be divided into three or more display areas, and a driving frequency of each of the display areas may be determined depending on the type of image (still image or moving image) displayed in each of the display areas.

Figure 2A:
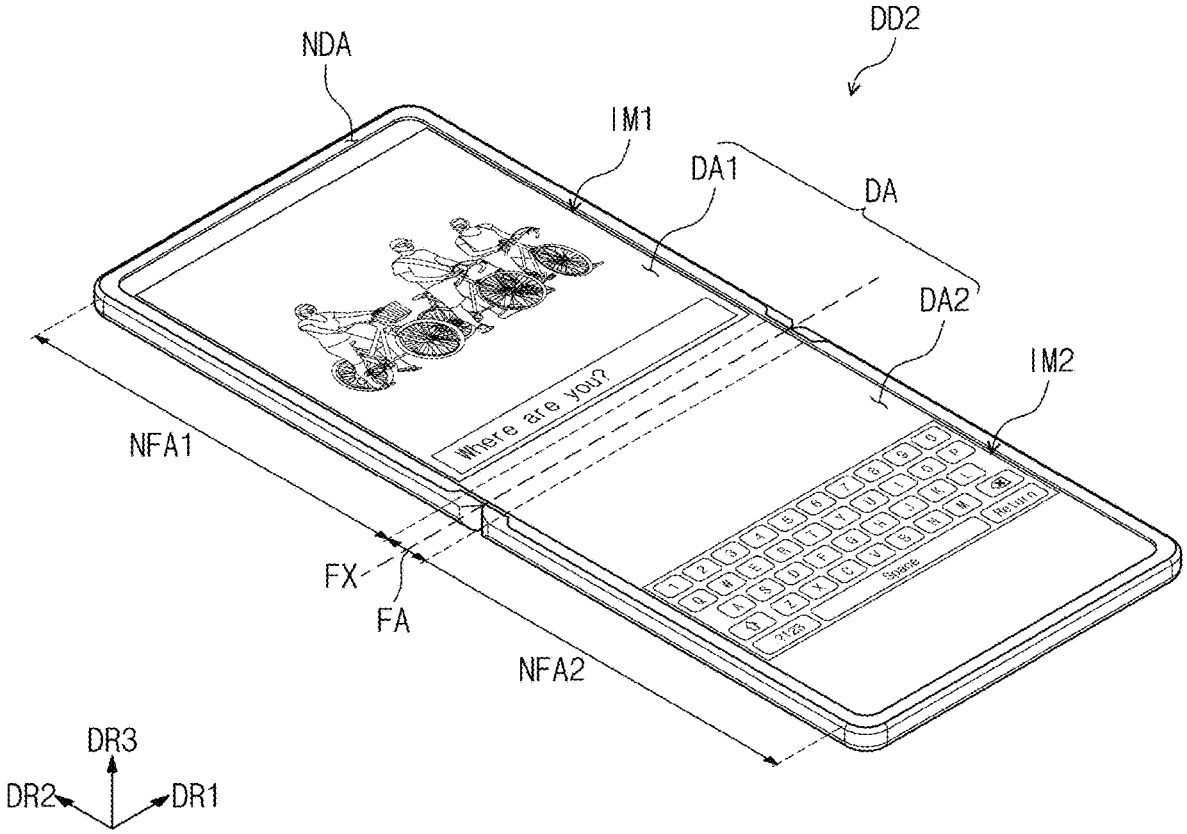
FIGS. 2A and 2B are perspective views showing a display device according to an embodiment of the present disclosure.
Figure 2B:
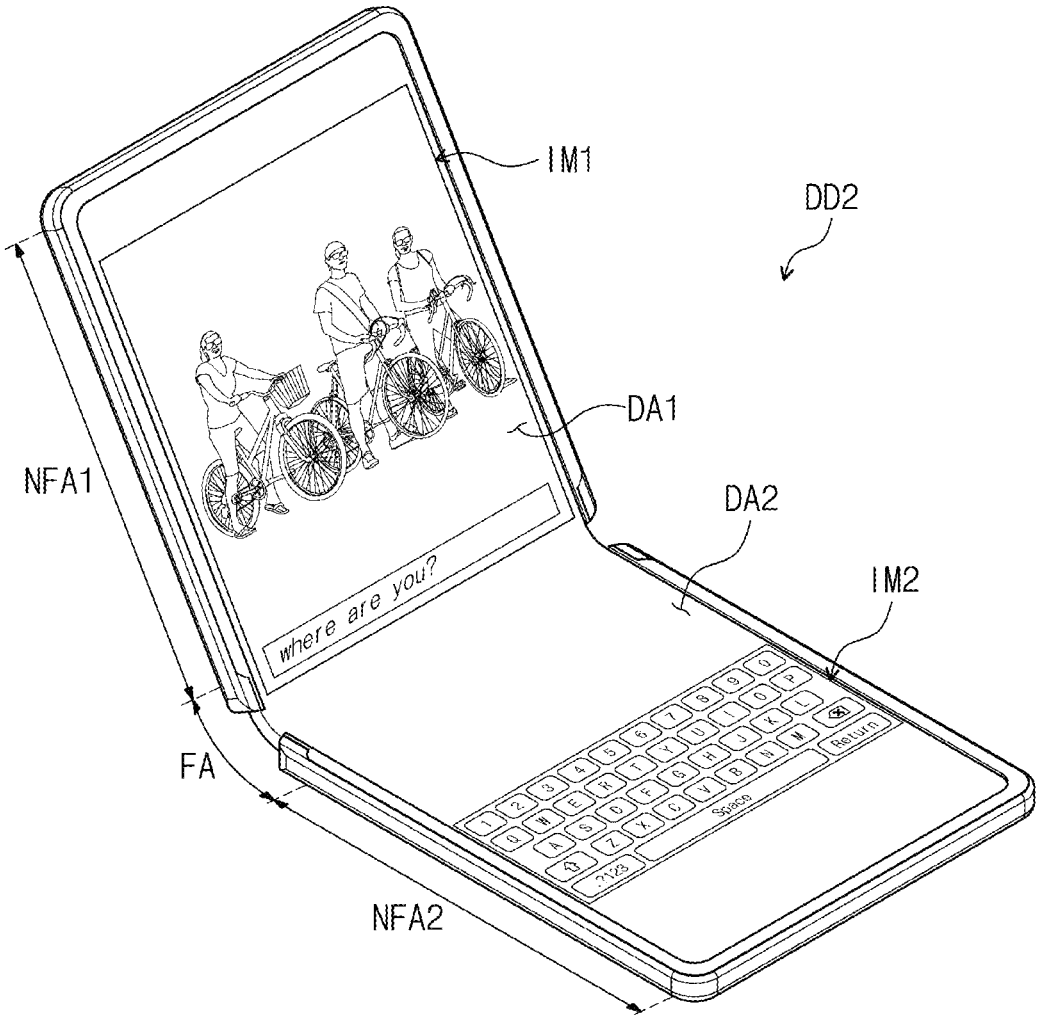

FIGS. 2A and 2B are perspective views showing a display device DD2 according to an embodiment of the present disclosure. FIG. 2A shows an unfolded state of the display device DD2, and FIG. 2B shows a folded state of the display device DD2.

Referring to FIGS. 2A and 2B, the display device DD2 may include a display area DA and a non-display area NDA. The display device DD2 may display an image through the display area DA. When the display device DD2 is in the unfolded state, the display area DA may include a plane defined by the first direction DR1 and the second direction DR2. A thickness direction of the display device DD2 may be substantially parallel to a third direction DR3 crossing the first direction DR1 and the second direction DR2. Accordingly, a front surface (or an upper surface) and a rear surface (or a lower surface) of each member of the display device DD2 may be defined with respect to the third direction DR3. The non-display area NDA may be referred to as the bezel area. As an example, the display area DA may have the quadrangular shape. The non-display area NDA may surround the display area DA.

The display area DA may include a first non-folding area NFA1, a folding area FA, and a second non-folding area NFA2. The folding area FA may be folded about a folding axis FX extending in the first direction DR1.

When the display device DD2 is folded, the first non-folding area NFA1 and the second non-folding area NFA2 may face each other. Accordingly, when the display device DD2 is completely folded, the display area DA may not be exposed to the outside, and this folding operation of the display device DD2 may be referred to as an in-folding operation. However, this is merely one example, and the operation of the display device DD2 should not be limited thereto or thereby.

For example, when the display device DD2 is folded, the first non-folding area NFA1 and the second non-folding area NFA2 may face opposite directions to each other. Accordingly, when the display device DD2 is folded, the first non-folding area NFA1 may be exposed to the outside, and this folding operation may be referred to as an out-folding operation.

The display device DD2 may be operated in only one of the in-folding operation and the out-folding operation. As another way, the display device DD2 may be operated in both the in-folding operation and the out-folding operation. In this case, the same area of the display device DD2, for example, the folding area FA may be inwardly folded ("in-folding") and outwardly folded ("out-folding"). As another way, a portion of the display device DD2 may be inwardly folded (in-folding), and the other portion of the display device DD2 may be outwardly folded (out-folding).

FIGS. 2A and 2B show one folding area and two non-folding areas as a representative example, however, the number of the folding areas and the number of the non-folding areas should not be limited thereto or thereby. For example, the display device DD2 may include two or more non-folding areas and a plurality of folding areas disposed between the non-folding areas.

In FIGS. 2A and 2B, the folding axis FX is substantially parallel to a minor axis of the display device DD2, however, the present disclosure according to the invention should not be limited thereto or thereby. For example, the folding axis FX may extend in a direction substantially parallel to a major axis of the display device DD2, e.g., the second direction DR2. In this case, the first non-folding area NFA1, the folding area FA, and the second non-folding area NFA2 may be sequentially arranged in the first direction DR1.

A plurality of display areas DA1 and DA2 may be defined in the display area DA of the display device DD2. FIG. 2A shows two display areas DA1 and DA2, however, the number of the display areas DA1 and DA2 should not be limited thereto or thereby.

The display areas DA1 and DA2 may include a first display area DA1 and a second display area DA2. For example, the first display area DA1 may be an area in which a first image IM1 is displayed, and the second display area DA2 may be an area in which a second image IM2 is displayed, however, they should not be limited thereto or thereby. For example, the first image IM1 may be a moving image, and the second image IM2 may be a still image or text information with a long cycle of change.

The display device DD2 may be operated differently depending on an operation mode. The operation mode may include a normal-frequency mode and a multi-frequency mode. In the normal-frequency mode, the display device DD2 may drive both the first display area DA1 and the second display area DA2 at the normal frequency. In the multi-frequency mode, the display device DD2 may drive the first display area DA1 in which the first image IM1 is displayed at a first driving frequency and may drive the second display area DA2 in which the second image IM2 is displayed at a second driving frequency lower than the normal frequency. According to an embodiment, the first driving frequency may be the same as the normal frequency.

Each of the first display area DA1 and the second display area DA2 may have a predetermined size, and the size of the first display area DA1 and the second display area DA2 may vary according to an application program. According to an embodiment, the first display area DA1 may correspond to the first non-folding area NFA1, and the second display area DA2 may correspond to the second non-folding area NFA2. In addition, a first portion of the folding area FA may correspond to the first display area DA1, and a second portion of the folding area FA may correspond to the second display area DA2.

According to an embodiment, the entire folding area FA may correspond to either the first display area DA1 or the second display area DA2.

According to an embodiment, the first display area DA1 may correspond to a first portion of the first non-folding area NFA1, and the second display area DA2 may correspond to a second portion of the first non-folding area NFA1, the folding area FA, and the second non-folding area NFA2. That is, the size of the second display area DA2 may be greater than the size of the first display area DA1.

According to an embodiment, the first display area DA1 may correspond to the first non-folding area NFA1, the folding area FA, and a first portion of the second non-folding area NFA2, and the second display area DA2 may correspond to a second portion of the second non-folding area NFA2. That is, the size of the first display area DA1 may be greater than the size of the second display area DA2.

As shown in FIG. 2B, when the folding area FA is folded, the first display area DA1 may correspond to the first non-folding area NFA1, and the second display area DA2 may correspond to the folding area FA and the second non-folding area NFA2.

In FIGS. 2A and 2B, the display device DD2 in which one folding area is defined is shown as a representative example, however, the present disclosure according to the invention should not be limited thereto or thereby. For example, the present disclosure may be applied to a display device including two or more folding areas, a rollable display device, or a slidable display device.

Hereinafter, the display device DD shown in FIG. 1 will be described in detail as a representative example, however, the following descriptions may be applied to the display device DD2 shown in FIGS. 2A and 2B.

Figure 3A:
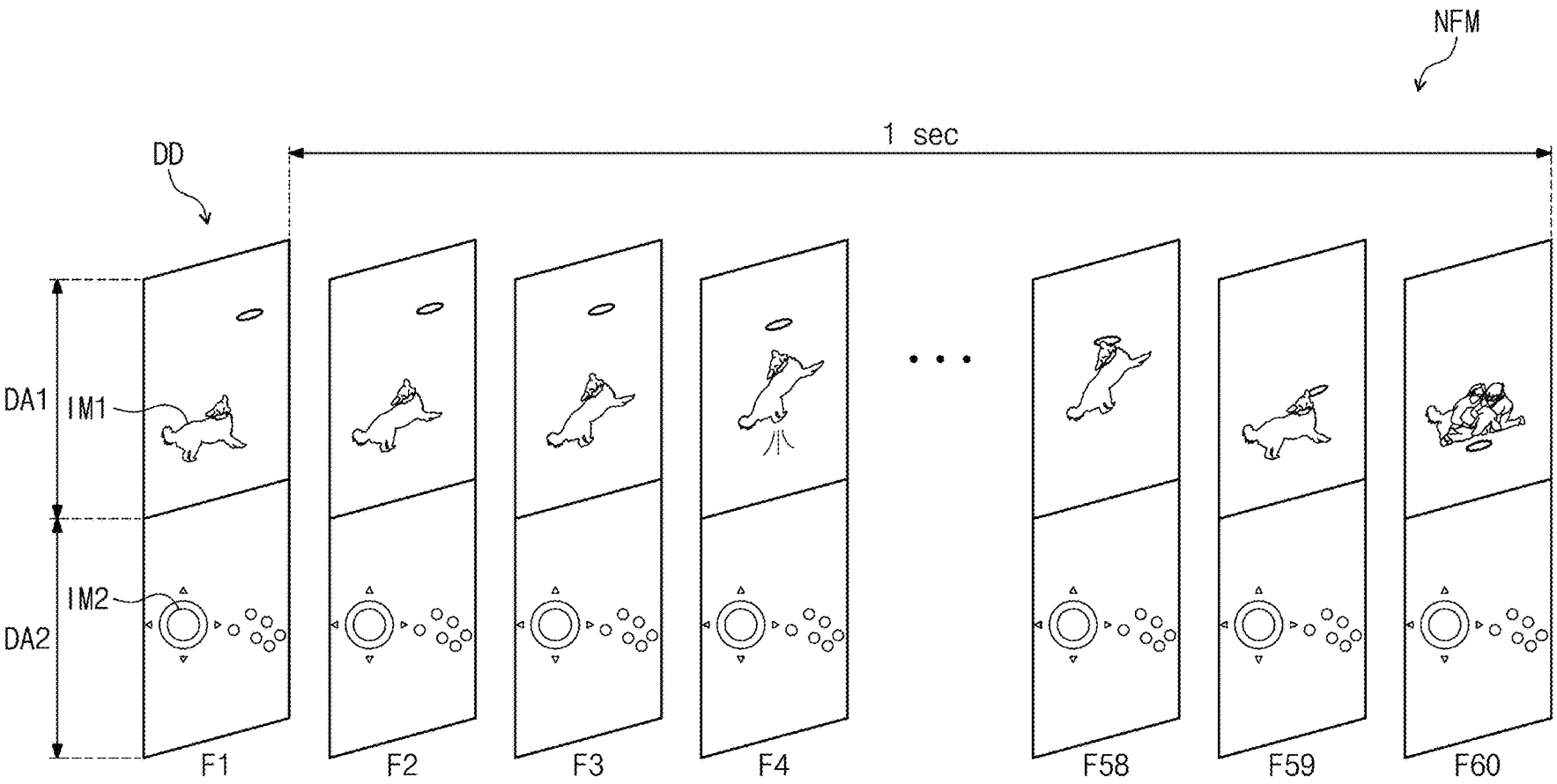
FIG. 3A is a view showing an operation of a display device in a normal-frequency mode.
Figure 3B:
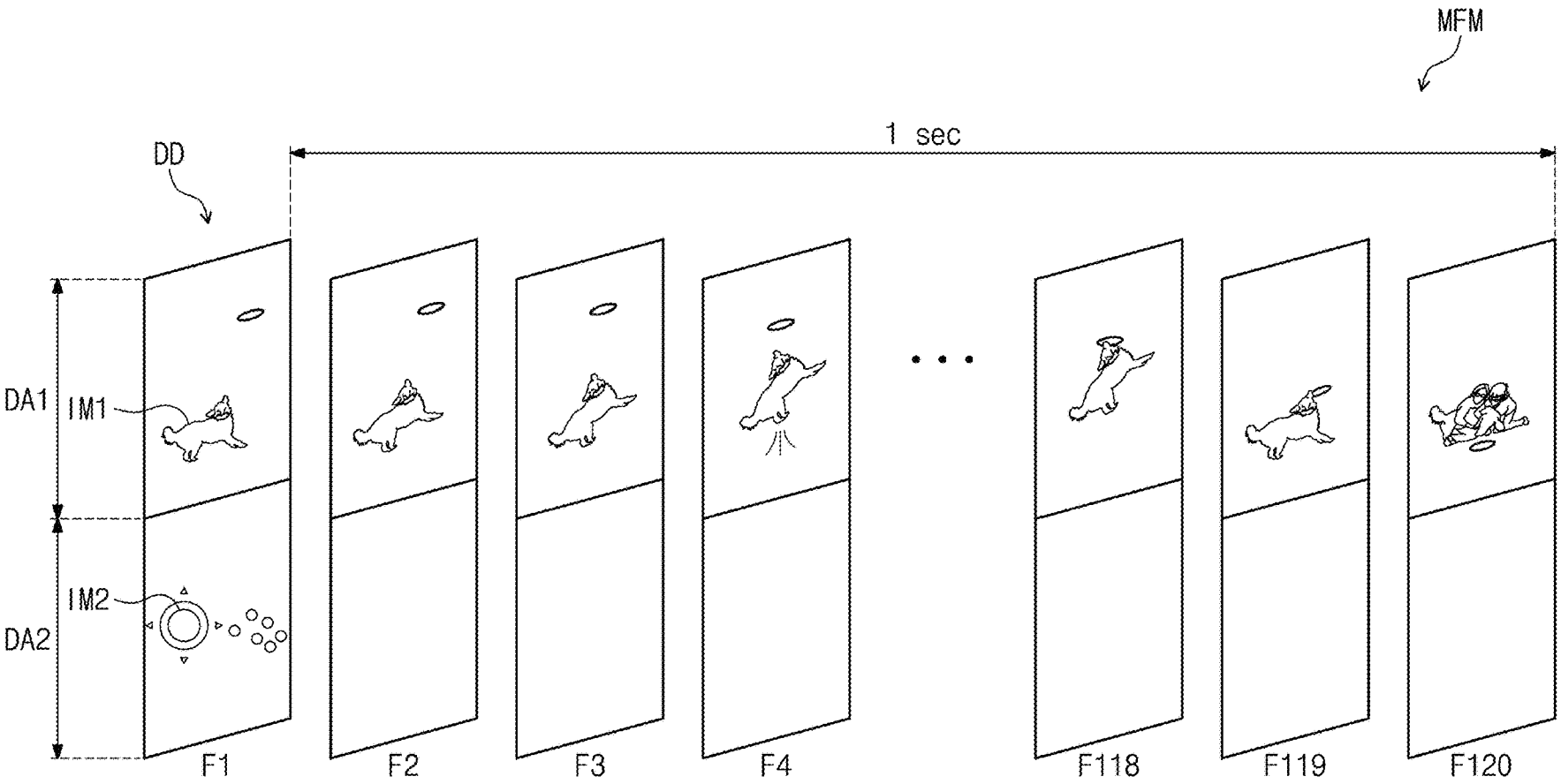
FIG. 3B is a view showing an operation of a display device in a multi-frequency mode.

FIG. 3A is a view showing an operation of the display device DD in the normal-frequency mode, and FIG. 3B is a view showing an operation of the display device in the multi-frequency mode.

Referring to FIG. 3A, the first image IM1 displayed in the first display area DA1 may be the moving image, and the second image IM2 displayed in the second display area DA2 may be the still image or the image with the long cycle of change, e.g., a keypad for the control of a game. The first image IM1 displayed in the first display area DA1 shown in FIG. 1 and the second image IM2 displayed in the second display area DA2 shown in FIG. 1 are merely examples, and various images may be displayed in the display device DD.

Hereinafter, for better understanding, the normal-frequency mode will be assigned with a reference character "NFM", and the multi-frequency mode will be assigned with a reference character "MFM".

In the normal-frequency mode NFM, the driving frequency of the first display area DA1 and the second display area DA2 of the display device DD may be the normal frequency. For example, the normal frequency may be about 60 Hertz (Hz). In the normal-frequency mode NFM, images of a first frame F1 to a sixtieth frame F60 may be displayed for 1 second in the first display area DA1 and the second display area DA2 of the display device DD.

Referring to FIG. 3B, during the multi-frequency mode MFM, the display device DD may set the driving frequency of the first display area DA1 in which the first image IM1, i.e., the moving image, is displayed to the first driving frequency and may set the driving frequency of the second display area DA2 in which the second image IM2, i.e., the still image, is displayed to the second driving frequency lower than the first driving frequency. When the normal frequency is about 60 Hz, the first driving frequency may be about 120 Hz, and the second driving frequency may be about 1 Hz. The first driving frequency and the second driving frequency may be changed in various ways. For example, the first driving frequency may be about 144 Hz that is higher than the normal frequency or may be about 60 Hz that is the same as the normal frequency. For example, the second driving frequency may be about one of about 30 Hz, about 10 Hz, and about 1 Hz that is lower than the normal frequency.

In the multi-frequency mode MFM, when the first driving frequency is about 120 Hz and the second driving frequency is about 1 Hz, the first image IM1 may be displayed for 1 second through the first display area DA1 in each of the first frame F1 to a 120th frame F120. The second image IM2 may be displayed in the second display area DA2 only in the first frame F1, and images may not be displayed in the other frames F2 to F120. The operation of the display device DD in the multi-frequency mode MFM will be described in detail later.

Figure 4:
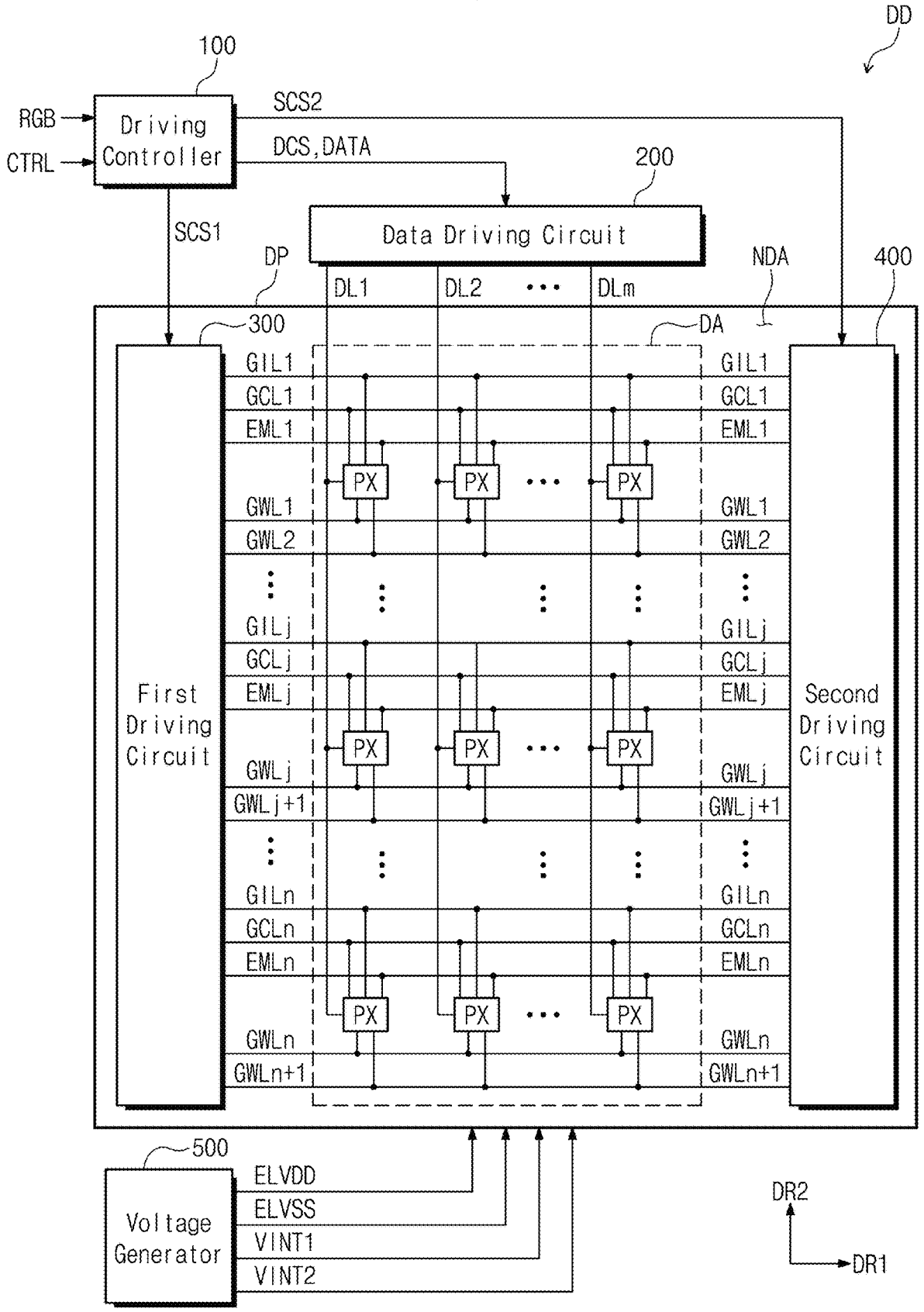
FIG. 4 is a block diagram showing a display device according to an embodiment of the present disclosure.

FIG. 4 is a block diagram showing the display device DD according to an embodiment of the present disclosure.

Referring to FIG. 4, the display device DD includes a display panel DP, a driving controller 100, a data driving circuit 200, and a voltage generator 500. The display panel DP includes a first driving circuit 300 and a second driving circuit 400.

The driving controller 100 receives an input signal including image signals RGB and control signals CTRL. The driving controller 100 converts a data format of the image signals RGB to a data format appropriate to an interface between the data driving circuit 200 and the driving controller 100 to generate image data signals DATA. The driving controller 100 controls the data driving circuit 200, the first driving circuit 300, and the second driving circuit 400 such that the image is displayed on the display panel DP. The driving controller 100 outputs a first scan control signal SCS1, a second scan control signal SCS2, and a data control signal DCS.

The data driving circuit 200 receives the data control signal DCS and the image data signals DATA from the driving controller 100. The data driving circuit 200 converts the image data signals DATA to data signals and outputs the data signals to a plurality of data lines DL1 to DLm (which will be described later). The data signals are analog voltages corresponding to grayscale values of the image data signals DATA.

The voltage generator 500 generates voltages to operate the display panel DP. In the present embodiment, the voltage generator 500 generates a first driving voltage ELVDD, a second driving voltage ELVSS, a first initialization voltage VINT1, and a second initialization voltage VINT2.

The display panel DP includes scan lines GIL1 to GILn, GCL1 to GCLn, and GWL1 to GWLn+1, light emitting control lines EML1 to EMLn, the data lines DL1 to DLm, and pixels PX. Here, "n" and "m" are natural numbers. The first driving circuit 300 may be disposed at a first side of the display panel DP, and the second driving circuit 400 may be disposed at a second side of the display panel DP. The scan lines GIL1 to GILn, GCL1 to GCLn, and GWL1 to GWLn+1 and the light emitting control lines EML1 to EMLn may be electrically connected to the first driving circuit 300 and the second driving circuit 400.

The scan lines GIL1 to GILn, GCL1 to GCLn, and GWL1 to GWLn+1 and the light emitting control lines EML1 to EMLn may extend in the first direction DR1 and be arranged in the second direction DR2 and may be spaced apart from each other. The data lines DL1 to DLm may extend in a direction (i.e., downward direction in FIG. 4) opposite to the second direction DR2 from the data driving circuit 200 and may be arranged in the first direction DR1 to be spaced apart from each other.

In the display device DD shown in FIG. 4, the first driving circuit 300 and the second driving circuit 400 may be disposed to face each other with the pixels PX interposed therebetween, however, the present disclosure according to the invention should not be limited thereto or thereby. According to another embodiment, the display panel DP may include only one of the first driving circuit 300 and the second driving circuit 400.

The pixels PX may be electrically connected to the scan lines GIL1 to GILn, GCL1 to GCLn, and GWL1 to GWLn+1, the light emitting control lines EML1 to EMLn, and the data lines DL1 to DLm, respectively. Each of the pixels PX may be electrically connected to four scan lines and one light emitting control line. For example, as shown in FIG. 4, the pixels arranged in a first row may be connected to the scan lines GIL1, GCL1, GWL1, and GWL2 and the first light emitting control line EML1. In addition, the pixels arranged in a j-th row may be connected to scan lines GILj, GCLj, GWLj, and GWLj+1 and j-th light emitting control line EMLj.

Each of the pixels PX may include a light emitting diode ED (refer to FIG. 5) and a pixel circuit PXC (refer to FIG. 5) that controls a light emission of the light emitting diode ED. The pixel circuit PXC may include one or more transistors and one or more capacitors. The first driving circuit 300 and the second driving circuit 400 may include transistors formed through the same process as the pixel circuit PXC.

Each of the pixels PX may receive the first driving voltage ELVDD, the second driving voltage ELVSS, the first initialization voltage VINT1, and the second initialization voltage VINT2.

The first driving circuit 300 may receive the first scan control signal SCS1 from the driving controller 100. The first driving circuit 300 may output scan signals to the scan lines GIL1 to GILn, GCL1 to GCLn, and GWL1 to GWLn+1 and may output light emitting signals to the light emitting control lines EML1 to EMLn in response to the first scan control signal SCS1.

The second driving circuit 400 may receive the second scan control signal SCS2 from the driving controller 100. The second driving circuit 400 may output the scan signals to the scan lines GIL1 to GILn, GCL1 to GCLn, and GWL1 to GWLn+1 and may output the light emitting signals to the light emitting control lines EML1 to EMLn in response to the second scan control signal SCS2.

The driving controller 100 according to an embodiment may divide the display panel DP into the first display area DA1 (refer to FIG. 1) and the second display area DA2 (refer to FIG. 1) and may set the driving frequency of the first display area DA1 and the driving frequency of the second display area DA2 independently based on the input signal including the image signals RGB and the control signals CTRL. For example, the driving controller 100 may drive each of the first display area DA1 and the second display area DA2 at the normal frequency, e.g., about 60 Hertz (Hz), in the normal-frequency mode NFM. The driving controller 100 may output the first scan control signal SCS1, the second scan control signal SCS2, and the data control signal DCS to drive the first display area DA1 at the first driving frequency, e.g., about 120 Hz, and to drive the second display area DA2 at the second driving frequency, e.g., about 1 Hz, in the multi-frequency mode MFM.

Figure 5:
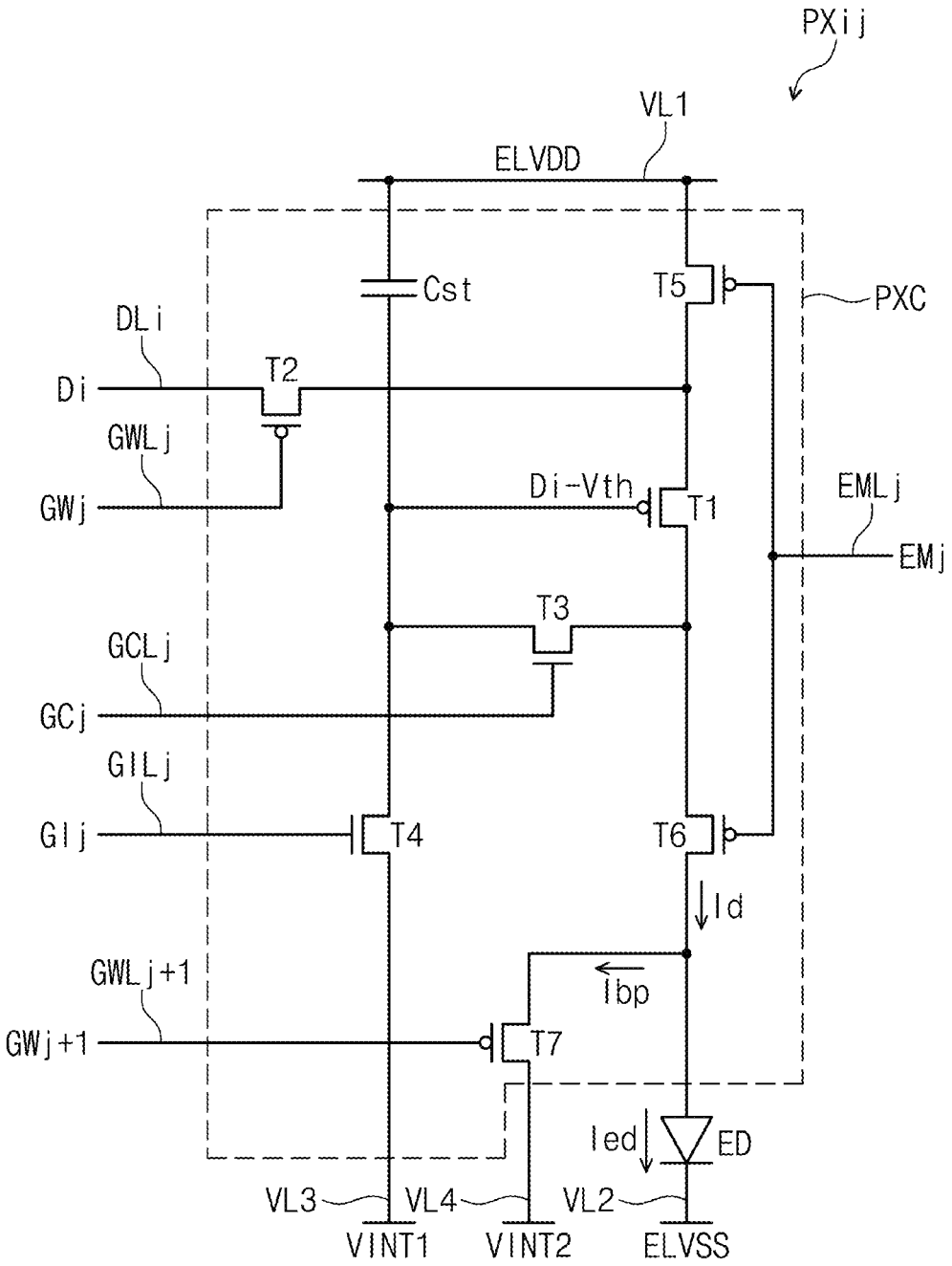
FIG. 5 is an equivalent circuit diagram showing a pixel according to an embodiment of the present disclosure.

FIG. 5 is an equivalent circuit diagram showing a pixel according to an embodiment of the present disclosure.

FIG. 5 shows an equivalent circuit diagram of a pixel PXij connected to an i-th data line DLi among the data lines DL1 to DLm, j-th scan lines GILj, GCLj, and GWLj and a (j+1)th scan line GWLj+1 among the scan lines GIL1-GILn, GCL1-GCLn and GWL1-GWLn+1, and a j-th light emitting control line EMLj among the light emitting control lines EML1 to EMLn shown in FIG. 4.

Each of the pixels PX shown in FIG. 4 may have substantially the same configuration as that of the equivalent circuit diagram of the pixel PXij shown in FIG. 5. In the present embodiment, the pixel circuit PXC of the pixel PXij may include first, second, third, fourth, fifth, sixth, and seventh transistors T1, T2, T3, T4, T5, T6, and T7. Among the first to seventh transistors T1 to T7, each of the third and fourth transistors T3 and T4 is an N-type transistor including an oxide semiconductor as its semiconductor layer, and each of the first, second, fifth, sixth, and seventh transistors T1, T2, T5, T6, and T7 is a P-type transistor including a low-temperature polycrystalline silicon ("LTPS") as its semiconductor layer. However, the present disclosure according to the invention should not be limited thereto or thereby, all the first to seventh transistors T1 to T7 may be the P-type transistor or the N-type transistor in another embodiment. According to another embodiment, at least one of the first to seventh transistors T1 to T7 may be the N-type transistor, and the other of the first to seventh transistors T1 to T7 may be the P-type transistor. In addition, the circuit configuration of the pixel according to the invention should not be limited to that shown in FIG. 5. The pixel circuit PXC shown in FIG. 5 is merely one example, and the configuration of the pixel circuit PXC may be changed.

Referring to FIG. 5, the pixel PXij of the display device may include the first to seventh transistors T1, T2, T3, T4, T5, T6, and T7, a capacitor Cst, and at least one light emitting diode ED. In the present embodiment, a structure in which one pixel PXij includes one light emitting diode ED will be described.

The scan lines GILj, GCLj, GWLj, and GWLj+1 may transmit scan signals GIj, GCj, GWj, and GWj+1, respectively, and the light emitting control line EMLj may transmit a light emitting signal EMj. The data line DLi may transmit a data signal Di. The data signal Di may have a voltage level corresponding to the image signal RGB input to the display device DD (refer to FIG. 4). First, second, third, and fourth driving voltage lines VL1, VL2, VL3, and VL4 may transmit the first driving voltage ELVDD, the second driving voltage ELVSS, the first initialization voltage VINT1, and the second initialization voltage VINT2, respectively.

The first transistor T1 may include a first electrode connected to the first driving voltage line VL1 via the fifth transistor T5, a second electrode electrically connected to an anode of the light emitting diode ED via the sixth transistor T6, and a gate electrode connected to one end of the capacitor Cst. The first transistor T1 may receive the data signal Di transmitted by the data line DLi according to a switching operation of the second transistor T2 and may supply a driving current Id to the light emitting diode ED.

The second transistor T2 may include a first electrode connected to the data line DLi, a second electrode connected to the first electrode of the first transistor T1, and a gate electrode connected to the scan line GWLj. The second transistor T2 may be turned on in response to the scan signal GWj applied thereto via the scan line GWLj and may transmit the data signal Di applied thereto via the data line DLi to the first electrode of the first transistor T1.

The third transistor T3 may include a first electrode connected to the gate electrode of the first transistor T1, a second electrode connected to the second electrode of the first transistor T1, and a gate electrode connected to the scan line GCLj. The third transistor T3 may be turned on in response to the scan signal GCj applied thereto via the scan line GCLj and may connect the gate electrode and the second electrode of the first transistor T1 to each other to allow the first transistor T1 to be connected in a diode configuration.

The fourth transistor T4 may include a first electrode connected to the gate electrode of the first transistor T1, a second electrode connected to the third driving voltage line VL3 to which the first initialization voltage VINT1 is transmitted, and a gate electrode connected to the scan line GILj. The fourth transistor T4 may be turned on in response to the scan signal GIj applied thereto via the scan line GILj and may transmit the first initialization voltage VINT1 to the gate electrode of the first transistor T1 to perform an initialization operation that initializes a voltage of the gate electrode of the first transistor T1.

The fifth transistor T5 may include a first electrode connected to the first driving voltage line VL1, a second electrode connected to the first electrode of the first transistor T1, and a gate electrode connected to the light emitting control line EMLj.

The sixth transistor T6 may include a first electrode connected to the second electrode of the first transistor T1, a second electrode connected to the anode of the light emitting diode ED, and a gate electrode connected to the light emitting control line EMLj.

The fifth transistor T5 and the sixth transistor T6 may be substantially simultaneously turned on in response to the light emitting signal EMj applied thereto via the light emitting control line EMLj, and the first driving voltage ELVDD may be compensated for by the first transistor T1 connected in the diode configuration and may be transmitted to the light emitting diode ED.

The seventh transistor T7 may include a first electrode connected to the second electrode of the sixth transistor T6, a second electrode connected to the fourth driving voltage line VL4, and a gate electrode connected to the scan line GWLj+1. The seventh transistor T7 may be turned on in response to the scan signal GWj+1 applied thereto via the scan line GWLj+1 and may bypass a current of the anode of the light emitting diode ED to the fourth driving voltage line VL4.

As described above, the one end of the capacitor Cst may be connected to the gate electrode of the first transistor T1, and the other end of the capacitor Cst may be connected to the first driving voltage line VL1. A cathode of the light emitting diode ED may be connected to the second driving voltage line VL2 that transmits the second driving voltage ELVSS. The structure of the pixel PXij according to the invention should not be limited to the structure shown in FIG. 5, and the number of the transistors, the number of the capacitors, which are included in one pixel PXij, and the connection relation may be changed in various ways.

Figure 6:
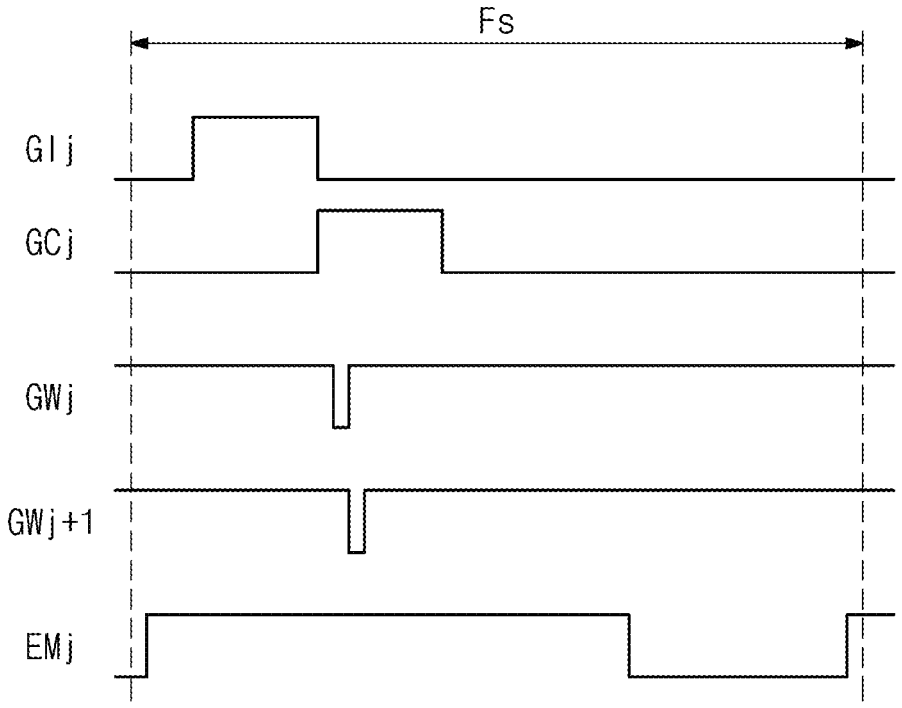
FIG. 6 is a timing diagram showing an operation of the pixel shown in FIG. 5.

FIG. 6 is a timing diagram showing an operation of the pixel shown in FIG. 5. The operation of the display device will be described in detail with reference to FIGS. 5 and 6.

Referring to FIGS. 5 and 6, the scan signal GIj having a high level is provided via the scan line GILj during an initialization period within one frame Fs. The fourth transistor T4 is turned on in response to the scan signal GIj having the high level, the first initialization voltage VINT1 is applied to the gate electrode of the first transistor T1 via the fourth transistor T4, and thus, the first transistor T1 is initialized.

Then, when the scan signal GCj having the high level is provided through the scan line GLj during a data programming and compensation period, the third transistor T3 is turned on. The first transistor T1 is connected in a diode configuration by the turned-on third transistor T3 and is forward-biased. In addition, the second transistor T2 is turned on in response to the scan signal GIj having a low level. Then, a compensation voltage Di-Vth that amounts to a value reduced by a threshold voltage Vth of the first transistor T1 from the data signal Di provided from the data line DLi is applied to the gate electrode of the first transistor T1. That is, a gate voltage applied to the gate electrode of the first transistor T1 may be the compensation voltage Di-Vth.

The first driving voltage ELVDD and the compensation voltage Di-Vth are applied to opposite ends of the capacitor Cst, respectively, and the capacitor Cst may be charged with electric charges corresponding to a difference in voltage between the opposite ends of the capacitor Cst.

The seventh transistor T7 is turned on in response to the scan signal GWj+1 having the low level applied thereto via the scan line GWLj+1. A portion of the driving current Id is bypassed to the fourth driving voltage line VL4 by the seventh transistor T7. The portion of the driving current Id is a bypass current Ibp flowing via the seventh transistor T7.

In a case where the light emitting diode ED emits a light even when a minimum current of the first transistor T1 displaying a black image flows as a driving current, the black image is not properly displayed. Accordingly, the seventh transistor T7 of the pixel PXij according to the embodiment may distribute a portion of the minimum current of the first transistor T1 to another current path as the bypass current Ibp other than a current path to the light emitting diode ED. In the present embodiment, the minimum current of the first transistor T1 means a current under a condition that a gate-source voltage (i.e., voltage difference between the gate electrode and the first electrode) of the first transistor T1 is less than the threshold voltage Vth and the first transistor T1 is turned off. In this way, the minimum driving current under the condition that the first transistor T1 is turned off, for example, a current of less than about 10 picoamperes (pA), is transmitted to the light emitting diode ED and is displayed as an image with a black luminance. In the case where the minimum driving current displaying the black image flows, an influence of bypass transmission of the bypass current Ibp is large, however, in the case where a large driving current displaying images such as a general image or a white image flows, almost no influence of the bypass current Ibp exists. Accordingly, when the driving current displaying the black image flows, the light emitting current led of the light emitting diode ED reduced by an amount of the bypass current Ibp from the driving current Id is bypassed through the seventh transistor T7 has a minimum current amount at a level that may clearly display the black image. Accordingly, a contrast ratio may be improved by providing an accurate black luminance image using the seventh transistor T7. In the present embodiment, the bypass signal corresponds to the scan signal GWj+1 having the low level, however, it should not be limited thereto or thereby.

Then, a level of the light emitting signal EMj provided from the light emitting control line EMLj is changed to a low level from a high level during a light emitting period. The fifth transistor T5 and the sixth transistor T6 are turned on in response to the light emitting signal EMj having the low level during the light emitting period. As a result, the driving current Id is generated due to a difference in voltage between the gate voltage of the gate electrode of the first transistor T1 and the first driving voltage ELVDD, the driving current Id is supplied to the light emitting diode ED via the sixth transistor T6, and thus, the current led flows through the light emitting diode ED.

Figure 7:
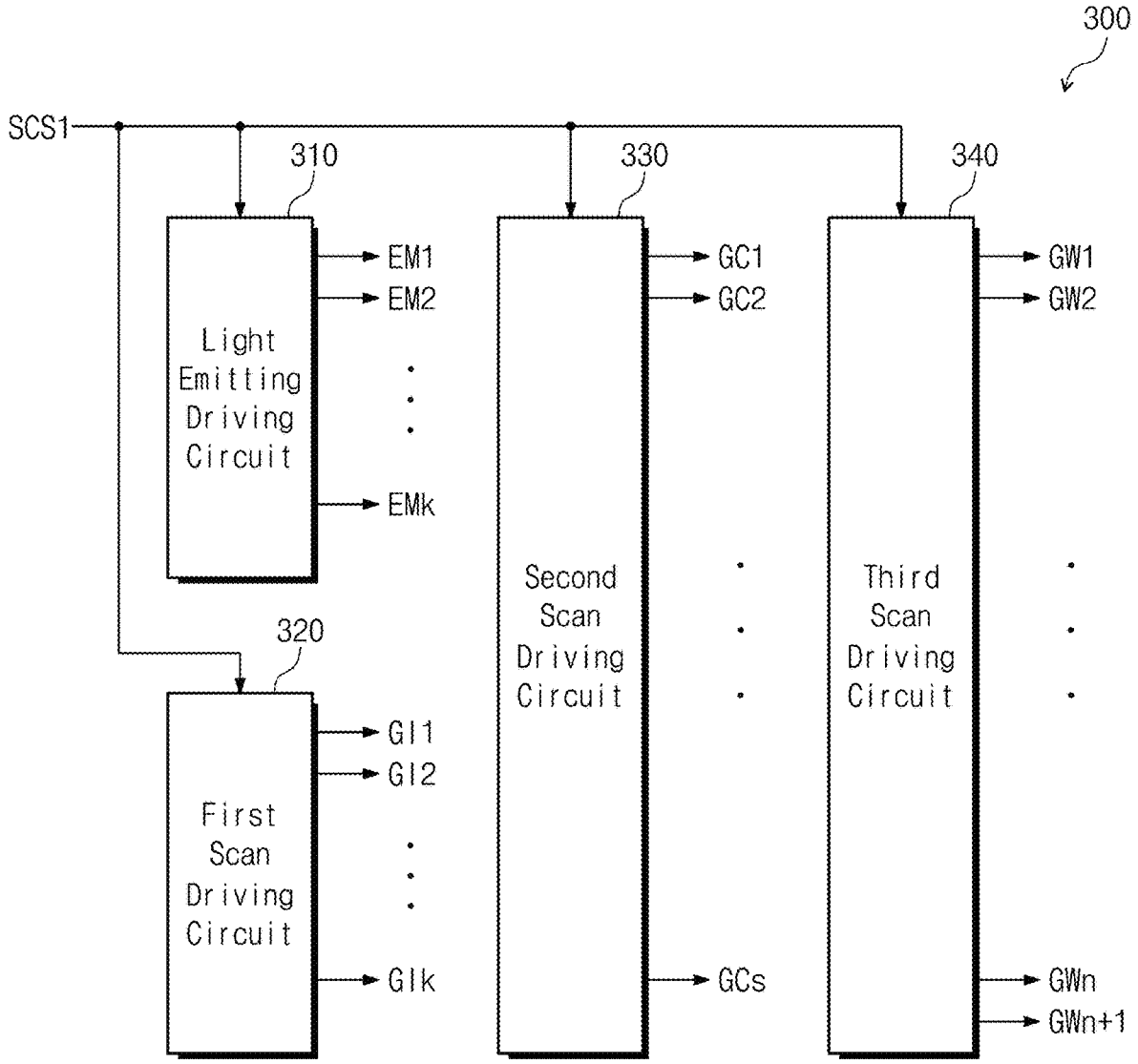
FIG. 7 is a block diagram showing a first driving circuit shown in FIG. 4.

FIG. 7 is a block diagram showing the first driving circuit 300 shown in FIG. 4.

Referring to FIG. 7, the first driving circuit 300 may include a light emitting driving circuit 310, a first scan driving circuit 320, a second scan driving circuit 330, and a third scan driving circuit 340.

The light emitting driving circuit 310 may output light emitting control signals EM1 to EMk, which are to be applied to the light emitting control lines EML1 to EMLn shown in FIG. 4, in response to the first scan control signal SCS1. In the present embodiment, "k" is a natural number, and the "n" may be greater than the "k" (n>k). That is, each of the light emitting control signals EM1 to EMk may be applied to one or more corresponding light emitting control lines among the light emitting control lines EML1 to EMLn.

The first scan driving circuit 320 may output scan signals GI1 to GIk, which are to be applied to the scan lines GIL1 to GILn shown in FIG. 4, in response to the first scan control signal SCS1. In the present embodiment, the "n" may be greater than the "k" (n>k). That is, each of the scan signals GI1 to GIk may be applied to one or more corresponding scan lines among the scan lines GIL1 to GILn.

The second scan driving circuit 330 may output scan signals GC1 to GCs, which are to be applied to the scan lines GCL1 to GCLn shown in FIG. 4, in response to the first scan control signal SCS1. In the present embodiment, "s" is a natural number, and the "n" may be greater than the "s" (n>s). That is, each of the scan signals GC1 to GCs may be applied to one or more corresponding scan lines among the scan lines GCL1 to GCLn.

The third scan driving circuit 340 may output scan signals GW1 to GWn, which are to be applied to the scan lines GWL1 to GWLn shown in FIG. 4, respectively, in response to the first scan control signal SCS1.

Figure 8:
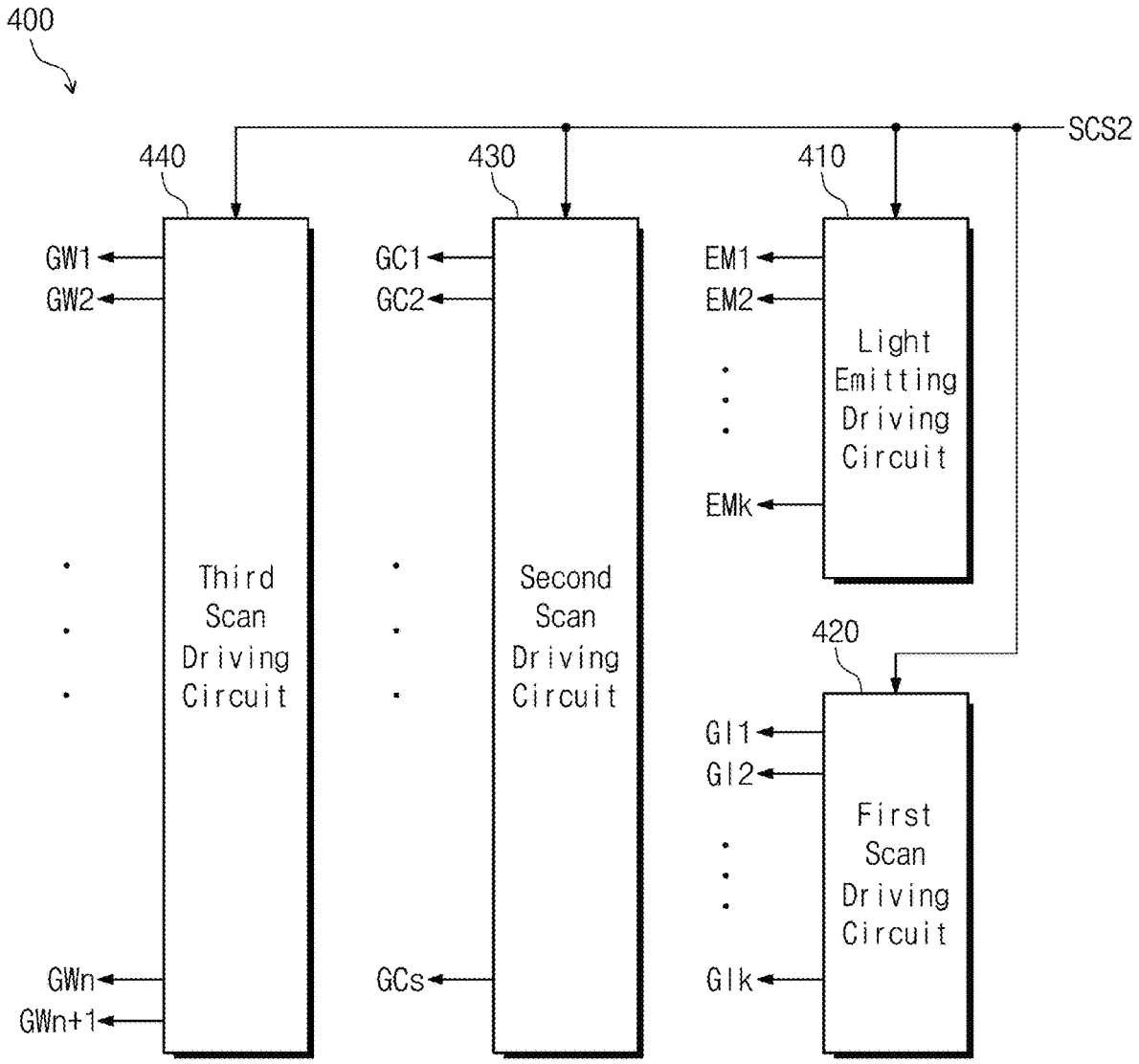
FIG. 8 is a block diagram showing a second driving circuit shown in FIG. 4.

FIG. 8 is a block diagram showing the second driving circuit 400 shown in FIG. 4.

Referring to FIG. 8, the second driving circuit 400 may include a light emitting driving circuit 410, a first scan driving circuit 420, a second scan driving circuit 430, and a third scan driving circuit 440.

The light emitting driving circuit 410 may output the light emitting control signals EM1 to EMk, which are to be applied to the light emitting control lines EML1 to EMLn shown in FIG. 4, in response to the second scan control signal SCS2.

The first scan driving circuit 420 may output the scan signals GI1 to GIk, which are to be applied to the scan lines GIL1 to GILn shown in FIG. 4, in response to the second scan control signal SCS2.

The second scan driving circuit 430 may output the scan signals GC1 to GCs, which are to be applied to the scan lines GCL1 to GCLn shown in FIG. 4, in response to the second scan control signal SCS2.

The third scan driving circuit 440 may output the scan signals GW1 to GWn, which are to be applied to the scan lines GWL1 to GWLn shown in FIG. 4, respectively, in response to the second scan control signal SCS2.

Figure 9:
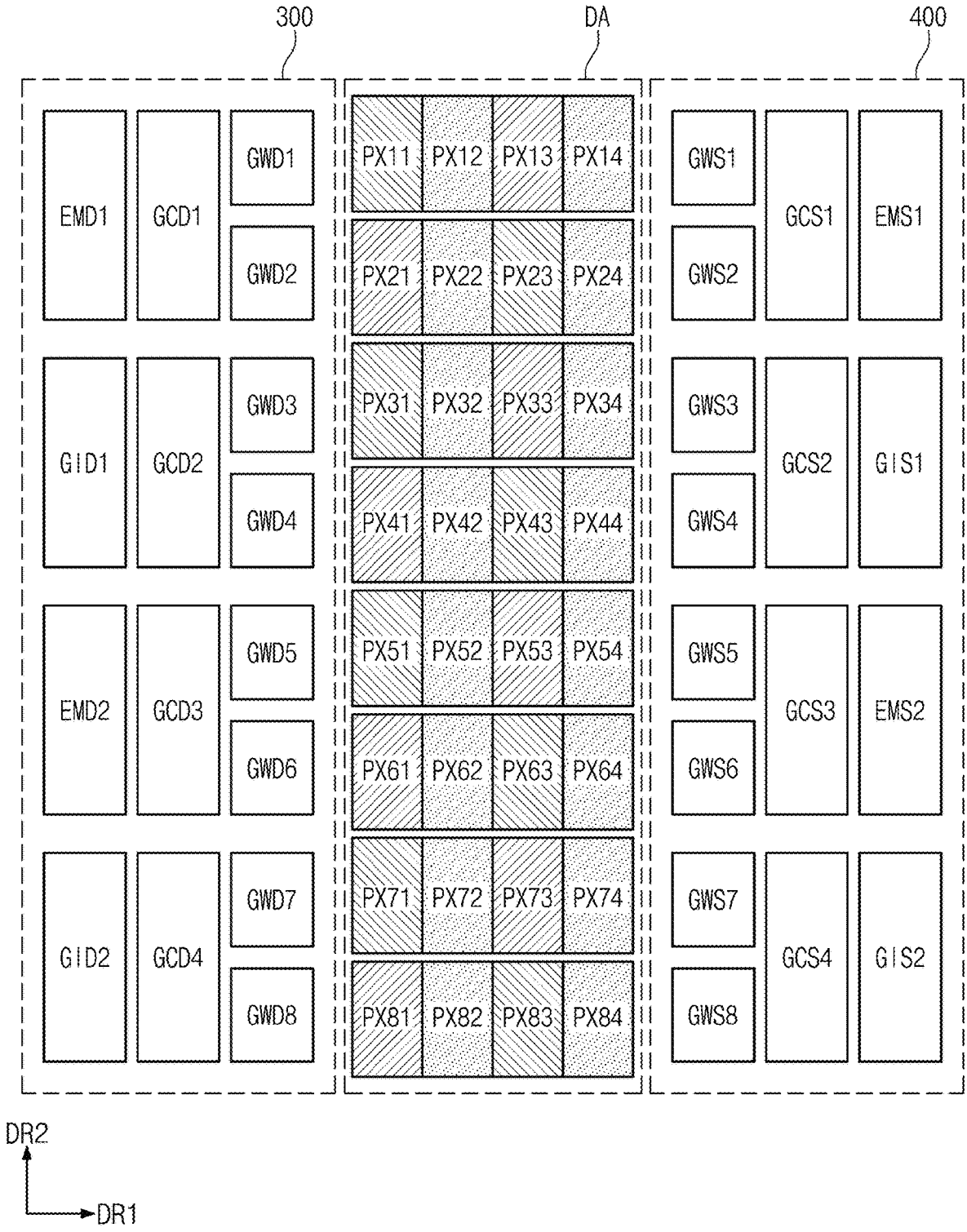
FIG. 9 is a block diagram showing the first driving circuit shown in FIG. 7 and the second driving circuit shown in FIG. 8.

FIG. 9 is a block diagram showing the first driving circuit 300 shown in FIG. 7 and the second driving circuit 400 shown in FIG. 8.

Referring to FIGS. 7 to 9, pixels PX11 to PX14, PX21 to PX24, PX31 to PX34, PX41 to PX44, PX51 to PX54, PX61 to PX64, PX71 to PX74, and PX81 to PX84 are arranged in part of the display area DA as an example.

FIG. 9 shows thirty-two pixels arranged in a matrix form of eight rows and four columns, i.e., an arrangement of eight pixels in the second direction DR2 and four pixels in the first direction DR1, however, the number of the pixels arranged in the display area DA may be changed in various ways.

Each of the pixels PX11, PX23, PX31, PX43, PX51, PX63, PX71, and PX83 is a first color pixel, e.g., a red pixel, each of the pixels PX13, PX21, PX33, PX41, PX53, PX61, PX73, and PX81 is a second color pixel, e.g., a blue pixel, and each of the pixels PX12, PX14, PX22, PX24, PX32, PX34, PX42, PX44, PX52, PX54, PX62, PX64, PX72, PX74, PX82, and PX84 is a third color pixel, e.g., a green pixel.

The light emitting driving circuit 310 of the first driving circuit 300 includes light emitting stages EMD1 to EMD2. The first scan driving circuit 320 of the first driving circuit 300 includes first scan stages GID1 to GID2. The second scan driving circuit 330 of the first driving circuit 300 includes second scan stages GCD1 to GCD4. The third scan driving circuit 340 of the first driving circuit 300 includes third scan stages GWD1 to GWD8.

Each of the light emitting stages EMD1 to EMD2 may drive the pixels arranged in four rows. For example, the light emitting stage EMD1 may drives the pixels PX11 to PX14, PX21 to PX24, PX31 to PX34, and PX41 to PX44. The light emitting stages EMD2 may drives the pixels PX51 to PX54, PX61 to PX64, PX71 to PX74, and PX81 to PX84.

Each of the first scan stages GID1 to GID2 may drive the pixels arranged in four rows. For example, the first scan stage GID1 may drives the pixels PX11 to PX14, PX21 to PX24, PX31 to PX34, and PX41 to PX44 arranged in first four rows. The first scan stage GID1 may drives the pixels PX51 to PX54, PX61 to PX64, PX71 to PX74, and PX81 to PX84 arranged in second four rows. Each of the second scan stages GCD1 to GCD4 may drive the pixels arranged in two rows. For example, the second scan stage GCD1 may drives the pixels PX11 to PX14 and PX21 to PX24 arranged in first two rows. The second scan stage GCD2 may drives the pixels PX31 to PX34, and PX41 to PX44 arranged in second two rows.

Each of the third scan stages GWD1 to GWD8 may drive the pixels arranged in one row. For example, the third scan stage GWD1 may drives the pixels PX11 to PX14 arranged in the first row. The third scan stage GWD2 may drives the pixels PX21 to PX24 arranged in the second row.

Each of the light emitting stages EMD1 and EMD2, the first scan stages GID1 and GID2, and the second scan stages GCD1 to GCD4 may have substantially the same length in the second direction DR2. According to an embodiment, each of the light emitting stages EMD1 and EMD2, the first scan stages GID1 and GID2, and the second scan stages GCD1 to GCD4 may have substantially the same circuit area as each other A length in the second direction DR2 of each of the third scan stages GWD1 to GWD8 may be a half (½) of the length in the second direction DR2 of each of the second scan stages GCD1 to GCD4.

The light emitting driving circuit 410 of the second driving circuit 400 may include light emitting stages EMS1 to EMS2. The first scan driving circuit 420 of the second driving circuit 400 may include first scan stages GIS1 to GIS2. The second scan driving circuit 430 of the second driving circuit 400 may include second scan stages GCS1 to GCS4. The third scan driving circuit 440 of the second driving circuit 400 may include third scan stages GWS1 to GWS8.

Each of the light emitting stages EMS1 to EMS2 may drive the pixels arranged in four rows.

Each of the first scan stages GIS1 to GIS2 may drive the pixels arranged in four rows.

Each of the second scan stages GCS1 to GCS4 may drive the pixels arranged in two rows.

Each of the third scan stages GWS1 to GWS8 may drive the pixels arranged in one row.

Each of the light emitting stages EMS1 and EMS2, the first scan stages GIS1 and GIS2, and the second scan stages GCS1 to GCS4 may substantially the same length as each other in the second direction DR2. According to an embodiment, each of the light emitting stages EMS1 and EMS2, the first scan stages GIS1 and GIS2, and the second scan stages GCS1 to GCS4 may have substantially the same circuit area as each other.

A length in the second direction DR2 of each of the third scan stages GWS1 to GWS8 may be a half (½) of the length in the second direction DR2 of each of the second scan stages GCS1 to GCS4.

In the embodiment shown in FIG. 9, the first scan stages GID1 to GID2 and the second scan stages GCD1 to GCD4 may have independent circuit configurations. In addition, the first scan stages GIS1 to GIS2 and the second scan stages GCS1 to GCS4 may have independent circuit configurations.

Figure 10:
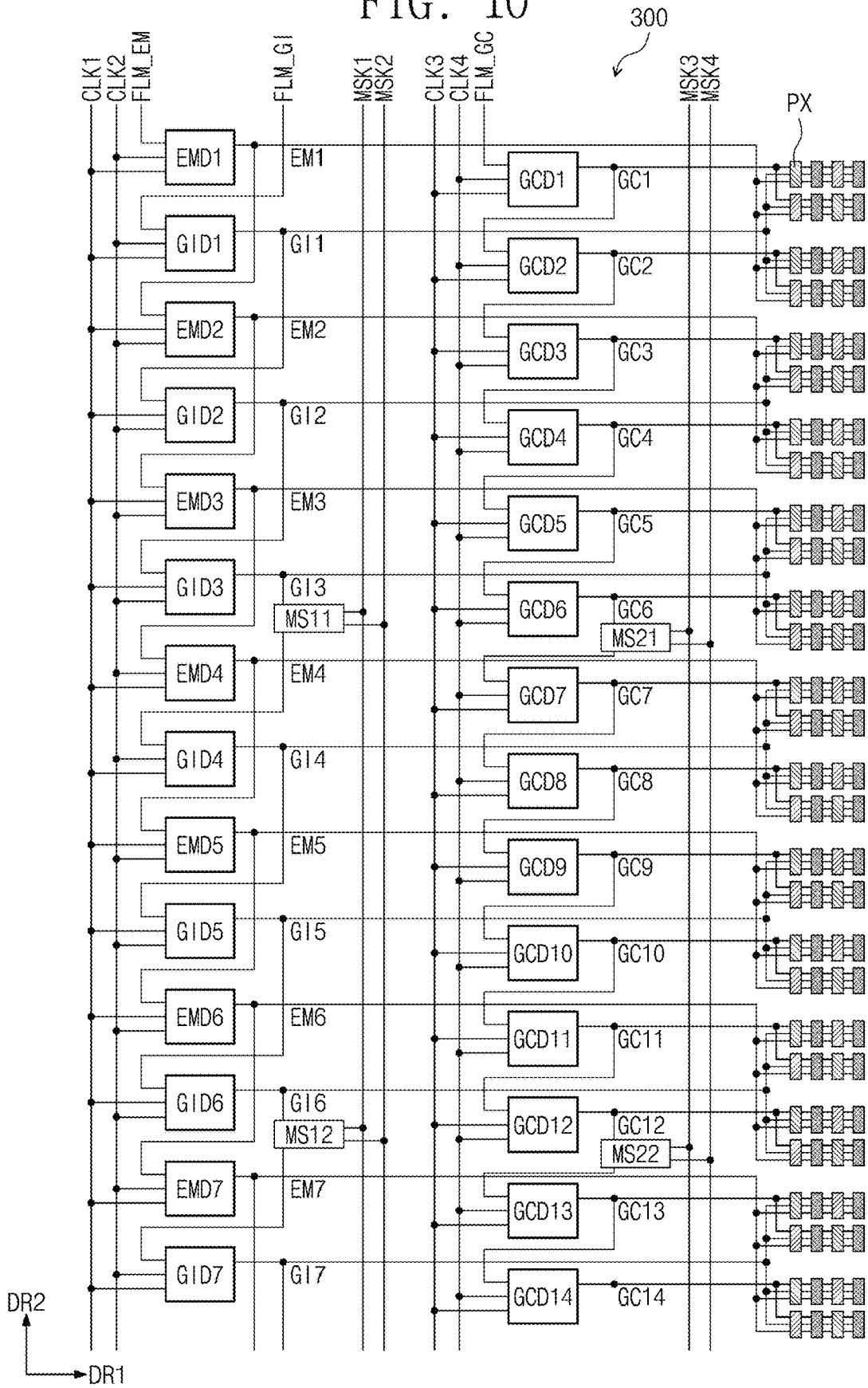
FIG. 10 is a view showing a light emitting stage, first scan stages, and second scan stages in the first driving circuit.

FIG. 10 shows light emitting stages EMD1 to EMD7, first scan stages GID1 to GID7, and second scan stages GCD1 to GCD14 of the first driving circuit 300.

Referring to FIGS. 9 and 10, the first driving circuit 300 further includes masking circuits MS11, MS12, MS21, and MS22.

The first masking circuit MS11 selectively outputs a scan signal GI3 output from a third first scan stage GID3 as a masking carry signal for the fourth first scan stage GID4 in response to a first masking signal MSK1 and a second masking signal MSK2.

The second masking circuit MS12 selectively outputs a scan signal GI6 output from a sixth first scan stage GID6 as the masking carry signal for the seventh first scan stage GID7 in response to the first masking signal MSK1 and the second masking signal MSK2.

The third masking circuit MS21 selectively outputs a scan signal GC6 output from a sixth second scan stage GCD6 as the masking carry signal for the seventh second scan stage GCD7 in response to a third masking signal MSK3 and a fourth masking signal MSK4.

The fourth masking circuit MS22 selectively outputs a scan signal GC12 output from a twelfth second scan stage GID12 as the masking carry signal for the thirteenth second scan stage GCD13 in response to the third masking signal MSK3 and the fourth masking signal MSK4.

Each of the light emitting stages EMD1 to EMD7 receives a first clock signal CLK1, a second clock signal CLK2, and a carry signal and outputs corresponding light emitting control signal. Each of the light emitting control signals EM1 to EM7 may be commonly applied to the pixels PX arranged in four consecutive rows along the second direction DR2. For example, the light emitting control signal EM1 output from the light emitting stage EMD1 may be applied to the pixels PX arranged in the first to fourth rows.

A first light emitting stage EMD1 receives a start signal FLM_EM as the carry signal. Each of the light emitting stages EMD2 to EMD7 except the first light emitting stage EMD1 receives a light emitting control signal output from a previous light emitting stage as the carry signal. For example, a second light emitting stage EMD2 receives the light emitting control signal EM1 output from the first light emitting stage EMD1 as the carry signal.

Each of the first scan stages GID1 to GID7 receives the first clock signal CLK1, the second clock signal CLK2, and the carry signal and outputs corresponding scan signal.

Each of the scan signals GI1 to GI7 may be commonly applied to the pixels PX arranged in four consecutive rows along the second direction DR2. For example, the scan signal GI1 output from the first scan stage GID1 may be applied to the pixels PX arranged in the first to fourth rows.

A first first scan stage GID1 receives a start signal FLM_GI as the carry signal. A fourth first scan stage GID4 receives the masking carry signal output from the masking circuit MS11. A seventh first scan stage GID7 receives the masking carry signal output from the masking circuit MS12. Each of the first scan stages GID2, GID3, GID5, and GID6 except the first scan stages GID1, GID4, and GID7 receives a scan signal output from a previous first scan stage as the carry signal. For example, a second first scan stage GID2 receives the scan signal GI1 output from the first first scan stage GID1 as the carry signal.

Each of the second scan stages GCD1 to GCD14 receives the third clock signal CLK3, the fourth clock signal CLK4, and the carry signal and outputs corresponding scan signal.

Each of the scan signals GC1 to GC14 may be commonly applied to the pixels PX arranged in two consecutive rows along the second direction DR2. For example, the scan signal GC1 output from the second scan stage GCD1 may be applied to the pixels PX arranged in first and second rows.

A first second scan stage GCD1 receives a start signal FLM_GC as the carry signal. A seventh second scan stage GCD7 receives the carry signal output from the masking circuit MS21. A thirteenth second scan stage GCD13 receives the carry signal output from the masking circuit MS22. Each of the second scan stages GCD2 to GCD6 and GCD8 to GCD12 except the second scan stage GCD1, GCD7, and GCD13 receives a scan signal output from a previous second scan stage as the carry signal. For example, a j-th (j is a natural number greater than 1) second scan stage GCDj receives a scan signal GCj−a output from a (j−a)th (a is a natural number) second scan stage GCDj−a as the carry signal. In this embodiment shown in FIG. 10, "a" is 1.

In FIG. 10, the masking circuits MS11 and MS12 are disposed every three first scan stages among the first scan stages GID1 to GID7, and the masking circuits MS21 and MS22 are disposed every six second scan stages among the second scan stages GCD1 to GCD14. The present disclosure according to the invention should not be limited to the embodiment shown in FIG. 10, and positions of the masking circuits MS11, MS12, MS21, and MS22 may be changed in various ways. For example, the masking circuit MS11 corresponds to a y-th (y is a natural number greater than 1) first scan stage GIDy and outputs a scan signal Gly output from the y-th first scan stage GIDy as the masking carry signal in response to the first and second masking signals MSK1 and MSK2. A (y+a)th (a is a natural number) first scan stage GIDy+a receives the masking carry signal output from the masking circuit MS11, i.e., the scan signal Gly, as the carry signal.

In FIG. 10, the third scan stages of the third scan driving circuit 340 (refer to FIG. 7) are not shown. However, the third scan stages may have substantially the same configuration as that of the first scan stages GID1 to GID7 and the second scan stages GCD1 to GCD14.

In addition, the second driving circuit 400 shown in FIG. 8 may have a circuit configuration similar to that of the first driving circuit 300 shown in FIG. 10.

Figure 11:
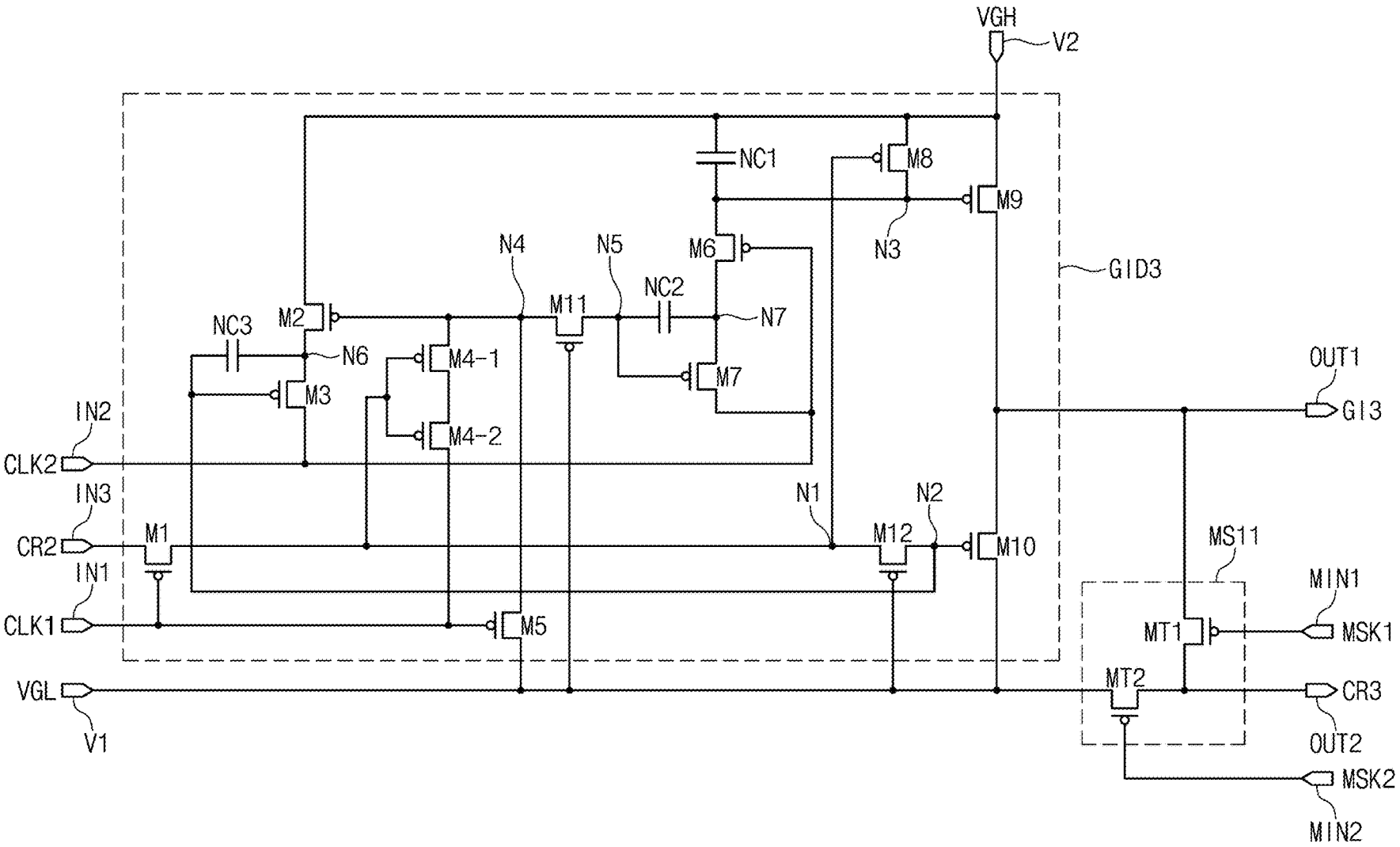
FIG. 11 is a circuit diagram showing a third first scan stage and a masking circuit in a first driving circuit according to an embodiment of the present disclosure.

FIG. 11 is a circuit diagram showing the third first scan stage GID3 and the masking circuit MS11 of the first driving circuit 300 according to an embodiment of the present disclosure.

FIG. 11 shows the third first scan stage GID3 among the first scan stages GID1 to GID7 shown in FIG. 10. Each of the first scan stages GID1, GID2, and GID4 to GID7 shown in FIG. 10 may have substantially the same circuit configuration as that of the third first scan stage GID3 shown in FIG. 11.

The masking circuits MS12, MS21, and MS22 shown in FIG. 10 may have substantially the same circuit configuration as that of the masking circuit MS11 shown in FIG. 11.

Referring to FIG. 11, the first scan stage GID3 includes first, second, and third input terminals IN1, IN2, and IN3, first and second voltage terminals V1 and V2, a scan output terminal OUT1, transistors M1, M2, M3, M4-1, M4-2, M5, M6, M7, M8, M9, M10, M11, and M12, and capacitors NC1, NC2, and NC3. Each of the transistors M1 to M12 is shown as the P-type transistor, however, the present disclosure according to the invention should not be limited thereto or thereby. All or a portion of the transistors M1 to M12 may be the N-type transistor in another embodiment.

The first scan stage GID3 receives a first clock signal CLK1, a second clock signal CLK2, and a carry signal CR2 via the first to third input terminals IN1 to IN3, respectively, and receives a first voltage VGL and a second voltage VGH via the first and second voltage terminals V1 and V2, respectively. The first scan stage GID3 outputs the scan signal GI3 via the scan output terminal OUT1. In the present embodiment, the carry signal CR2 provided via the third input terminal IN3 is a scan signal GI2 output from the second first scan stage GID2.

The first input terminal IN1 of some scan stages among the first scan stages GID1 to GID7 shown in FIG. 10, e.g., odd-numbered scan stages, receive the first clock signal CLK1, and the second input terminals IN2 of the some scan stages among the first scan stages GID1 to GID7 receive the second clock signal CLK2. In addition, the first input terminal IN1 of the other scan stages among the first scan stages GID1 to GID7 shown in FIG. 10, e.g., even-numbered scan stages, receive the second clock signal CLK2, and the second input terminals IN2 of the other scan stages among the first scan stages GID1 to GID7 receive the first clock signal CLK1.

The transistor M1 is connected between the third input terminal IN3 and a first node N1 and includes a gate electrode connected to the first input terminal IN1. The transistor M2 is connected between the second voltage terminal V2 and a sixth node N6 and includes a gate electrode connected to a fourth node N4. The transistor M3 is connected between the sixth node N6 and the second input terminal IN2 and include a gate electrode connected to a second node N2.

The transistors M4-1 and M4-2 are connected between the fourth node N4 and the first input terminal IN1 in series. Each of the transistors M4-1 and M4-2 includes a gate electrode connected to the first node N1. The transistor M5 is connected between the fourth node N4 and the first voltage terminal V1 and includes a gate electrode connected to the first input terminal IN1. The transistor M6 is connected between a third node N3 and a seventh node N7 and includes a gate electrode connected to the second input terminal IN2. The transistor M7 is connected between the seventh node N7 and the second input terminal IN2 and includes a gate electrode connected to a fifth node N5.

The transistor M8 is connected between the second voltage terminal V2 and the third node N3 and includes a gate electrode connected to the first node N1. The transistor M9 is connected between the second voltage terminal V2 and the scan output terminal OUT1 and includes a gate electrode connected to the third node N3. The transistor M10 is connected between the scan output terminal OUT1 and the first voltage terminal V1 and includes a gate electrode connected to the second node N2. The transistor M11 is connected between the fourth node N4 and the fifth node N5 and includes a gate electrode connected to the first voltage terminal V1. The transistor M12 is connected between the first node N1 and the second node N2 and includes a gate electrode connected to the first voltage terminal V1.

The capacitor NC1 is connected between the second voltage terminal V2 and the third node N3. The capacitor NC2 is connected between the fifth node N5 and the seventh node N7. The capacitor NC3 is connected between the sixth node N6 and the second node N2.

The masking circuit MS11 includes first and second masking transistors MT1 and MT2, first and second masking input terminals MIN1 and MIN2, and a carry output terminal OUT2.

The masking circuit MS11 stops (or masks) the output of a carry signal CR3 in response to the first masking signal MSK1 applied thereto via the first masking input terminal MIN1 and sets the carry signal CR3 as the first voltage VGL in response to the second masking signal MSK2 applied thereto via the second masking input terminal MIN2.

The masking transistor MT1 is connected between the scan output terminal OUT1 and the carry output terminal OUT2 and includes a gate electrode connected to the first masking input terminal MIN1. The masking transistor MT2 is connected between the first voltage terminal V1 and the carry output terminal OUT2 and includes a gate electrode connected to the second masking input terminal MIN2.

When the first masking signal MSK1 provided through the first masking input terminal MIN1 has a low level and the second masking signal MSK2 provided through the second masking input terminal MIN2 has a high level, the masking circuit MS11 may output the scan signal GI3 as the carry signal CR3.

When the first masking signal MSK1 provided through the first masking input terminal MIN1 has the high level and the second masking signal MSK2 provided through the second masking input terminal MIN2 has the low level, the masking circuit MS11 may not output the scan signal GI3 as the carry signal CR3, and the carry signal CR3 may be maintained at the first voltage VGL.

Figure 12:
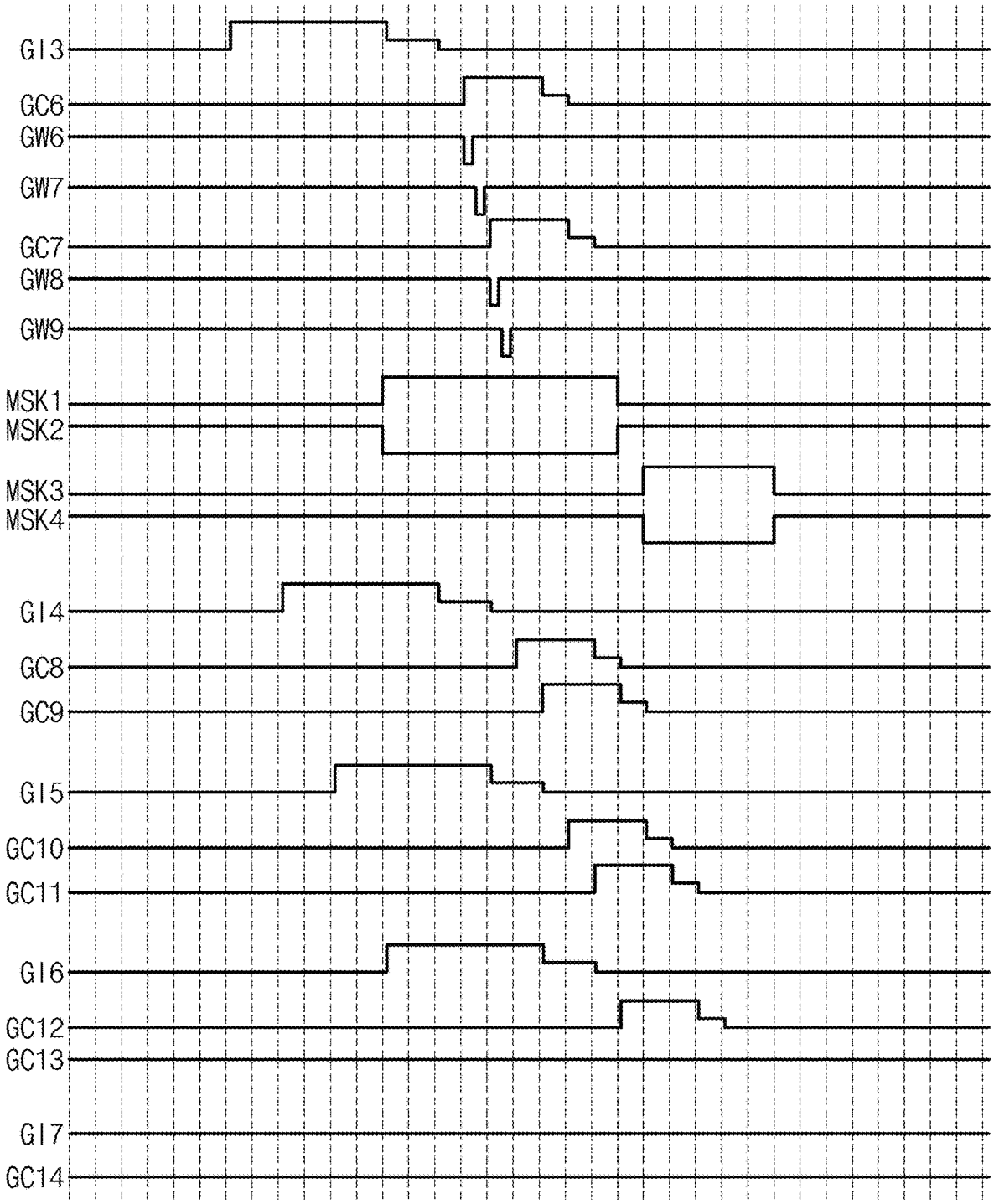
FIG. 12 is a timing diagram showing scan signals output from the first scan stages shown in FIG. 10, scan signals output from second scan stages, and first to fourth masking signals in the multi-frequency mode.

FIG. 12 is a timing diagram showing the scan signals GI3 to GI7 output from the first scan stages GID3 to GID7 shown in FIG. 10, respectively, scan signals output from second scan stages GCD6 to GCD14, and first to fourth masking signals MSK1 to MSK4 in the multi-frequency mode. FIG. 12 also shows scan signals GW6 to GW9 applied to the scan lines GWL6 to GWL9, respectively.

Referring to FIGS. 10, 11, and 12, when the first masking signal MSK1 provided through the first masking input terminal MIN1 has the low level and the second masking signal MSK2 provided through the second masking input terminal MIN2 has the high level, the masking circuit MS11 may output the scan signal GI3 as the carry signal CR3. Accordingly, the scan signals GI3 to GI6 may be sequentially activated at high level.

In addition, when the third masking signal MSK3 has the low level and the fourth masking signal MSK4 has the high level, the masking circuit MS21 may output the scan signal GC6 as the carry signal for the seventh second scan stage GCD7. Accordingly, the scan signals GC6 to GC12 may be sequentially activated at high level.

When the first masking signal MSK1 is transited to the high level and the second masking signal MSK2 is transited to the low level, the masking circuit MS12 may not output the scan signal GI6 as the carry signal for the seventh first scan stage GID7, and the carry signal output from the masking circuit MS12 may be maintained at the first voltage VGL. Accordingly, the scan signal GI7 output from the first scan stage GID7 may be maintained at low level.

In addition, when the third masking signal MSK3 is transited to the high level and the fourth masking signal MSK4 is transited to the low level, the masking circuit MS22 may not output the scan signal GC12 as the carry signal for the thirteenth second scan stage GCD13, and the carry signal output from the masking circuit MS22 may be maintained at the first voltage VGL. Accordingly, the scan signals GC13 and GC14 output from the second scan stages GCD13 and GCD14 may be maintained at low level.

As described above, the length in the second direction DR2 of the first display area DA1 and the second display area DA2 shown in FIG. 1 may be adjusted according to the level of the first to fourth masking signals MSK1 to MSK4.

Figure 13A:
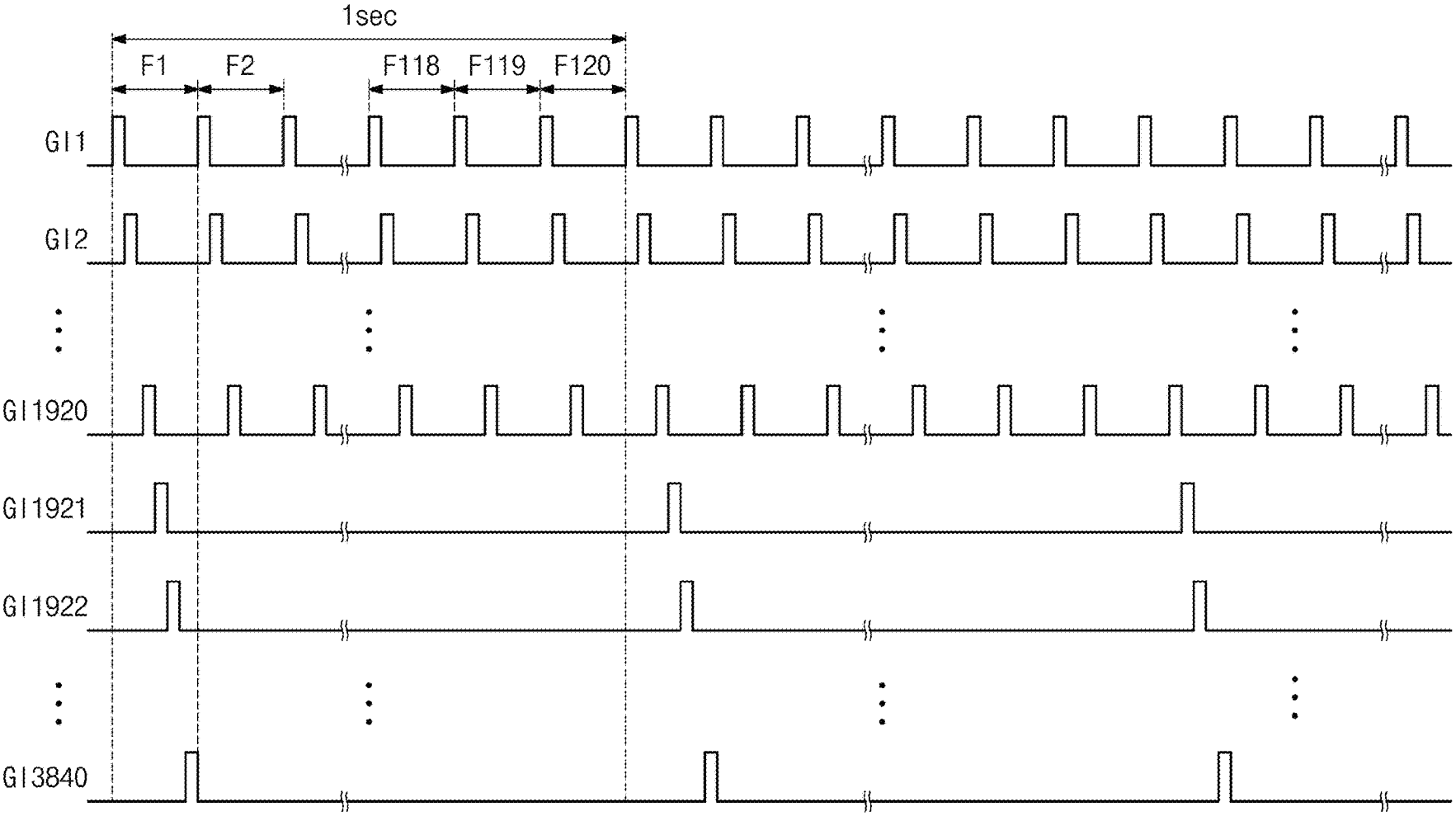
FIGS. 13A and 13B are timing diagrams showing scan signals in the multi-frequency mode.
Figure 13B:
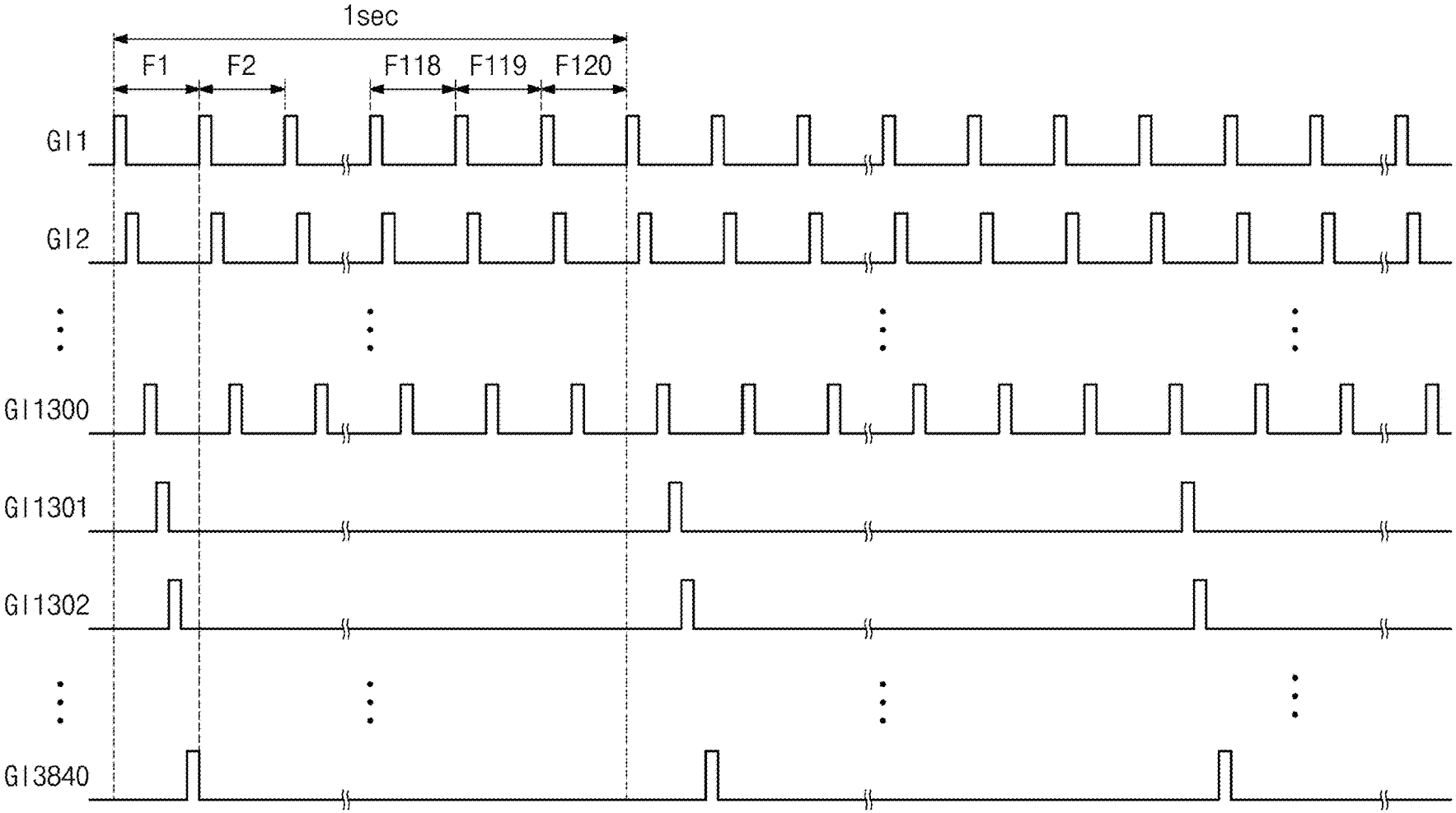

FIGS. 13A and 13B are timing diagrams showing scan signals GI1 to GI3840 in the multi-frequency mode.

Referring to FIGS. 1 and 13A, a frequency of the scan signals GI1 to GI1920 is about 120 Hz in the multi-frequency mode MFM, and a frequency of the scan signals GI1921 to GI3840 is about 1 Hz in the multi-frequency mode MFM.

For example, the scan signals GI1 to GI1920 correspond to the first display area DA1 of the display device DD shown in FIG. 1, and the scan signals GI1921 to GI3840 correspond to the second display area DA2.

The scan signals GI1 to GI1920 are activated at high level in each of first frame F1 to 120th frame F120, and the scan signals GI1921 to GI3840 are activated at high level only in the first frame F1.

Accordingly, the first display area DA1 in which the moving image is displayed is driven in response to the scan signals GI1 to GI1920 at a normal frequency, e.g., about 120 Hz, and the second display area DA2 in which the still image is displayed is driven in response to the scan signals GI1921 to GI3840 at a low frequency, e.g., about 1 Hz. Since only the second display area DA2 in which the still image is displayed is driven at the low frequency, the power consumption of the display device DD (refer to FIG. 1) may be reduced without deterioration in display quality.

FIG. 13A shows only the scan signals GI1 to GI3840, however, the light emitting driving circuit 310, the second scan driving circuit 330, and the third scan driving circuit 340 shown in FIG. 7 and the light emitting driving circuit 410, the second scan driving circuit 430, and the third scan driving circuit 440 shown in FIG. 8 may generate the scan signals GC1 to GC3840 and GW1 to GW3840 and the light emitting signals EM1 to EM3840 similar to the scan signals GI1 to GI3840.

Referring to FIGS. 1 and 13B, in the multi-frequency mode MFM, a frequency of the scan signals GI1 to GI1300 is about 120 Hz, and a frequency of the scan signals GI1301 to GI3840 is about 1 Hz.

For example, the scan signals GI1 to GI1300 correspond to the first display area DA1 of the display device DD shown in FIG. 1, and the scan signals GI1301 to GI3840 correspond to the second display area DA2.

The scan signals GI1 to GI1300 are activated at high level in each of the first frame F1 to 120th frame F120, and the scan signals GI1301 to GI3840 are activated at high level only in the first frame F1.

Accordingly, the first display area DA1 in which the moving image is displayed is driven in response to the scan signals GI1 to GI1300 at a normal frequency, e.g., about 120 Hz, and the second display area DA2 in which the still image is displayed is driven in response to the scan signals GI1301 to GI3840 at a low frequency, e.g., about 1 Hz. Since only the second display area DA2 in which the still image is displayed is driven at the low frequency, the power consumption of the display device DD (refer to FIG. 1) may be reduced without deterioration in display quality.

As shown in FIGS. 13A and 13B, the size of the first display area DA1 driven at the normal frequency and the size of the second display area DA2 driven at the low frequency may be varied. As shown in FIG. 13B, when the size of the second display area DA2 driven at the low frequency increases, the power consumption of the display device DD may be more reduced.

Figure 14:
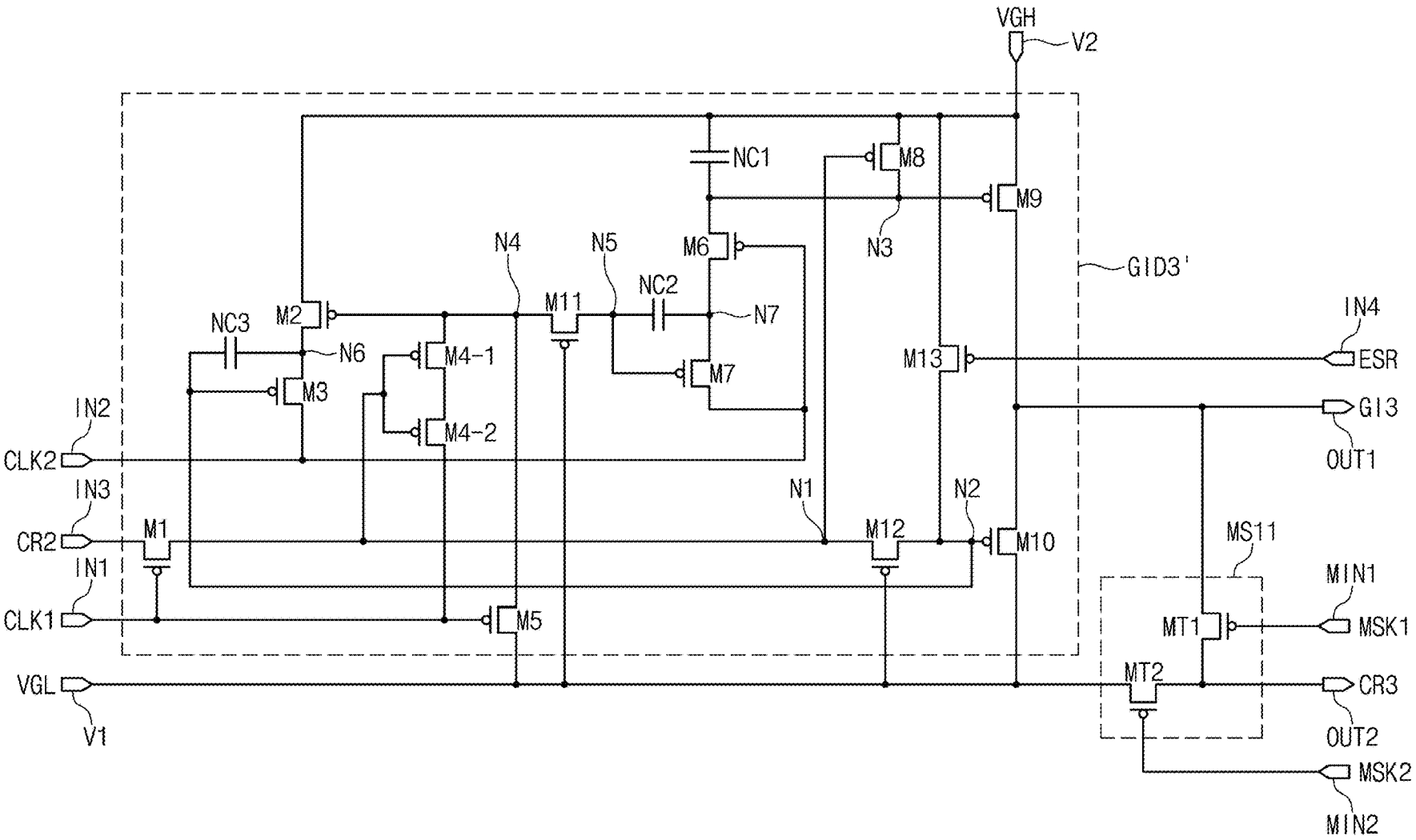
FIG. 14 is a circuit diagram showing a third first scan stage and a masking circuit in a first driving circuit according to an embodiment of the present disclosure.

FIG. 14 is a circuit diagram showing a third first scan stage GID3' and a masking circuit MS11 in a first driving circuit 300 according to an embodiment of the present disclosure.

The first scan stage GID3' shown in FIG. 14 has a circuit configuration similar to that of the first scan stage GID3 shown in FIG. 11 and further includes a transistor M13 and a fourth input terminal IN4.

The transistor M13 is connected between a second voltage terminal V2 and a second node N2 and includes a gate electrode connected to the fourth input terminal IN4. The fourth input terminal IN4 receives a reset signal ESR. The reset signal ESR may be a signal included in the first scan control signal SCS1 and the second scan control signal SCS2 provided from the driving controller 100 shown in FIG. 4.

The reset signal ESR may be activated at a low level when the display device DD is powered on or reset. When the reset signal ESR has the low level, the transistor M13 is turned on, and thus, a first node N1 and the second node N2 are maintained at a voltage level of a second voltage VGH, i.e., a high level. Accordingly, since transistors M3, M4-1, M4-2, M8, and M10 are maintained in a turned-off state, it is possible to prevent a scan signal GI3 output to an output terminal OUT1 from being output at an undesired level.

Although the embodiments of the present disclosure have been described, it is understood that the present disclosure according to the invention should not be limited to these embodiments but various changes and modifications can be made by one ordinary skilled in the art within the spirit and scope of the present disclosure as hereinafter claimed. Therefore, the disclosed subject matter should not be limited to any single embodiment described herein, and the scope of the present inventive concept shall be determined according to the attached claims.

What is claimed is:

1. A driving circuit comprising:

a plurality of scan stages, each of which corresponds to a plurality of scan lines, receives clock signals and a carry signal, and outputs a scan signal; and a plurality of masking circuits corresponding to some scan stages, respectively, among the plurality of scan stages, wherein each of the plurality of masking circuits outputs through a carry output terminal one of i) the scan signal output from a corresponding scan stage and ii) a first voltage as a masking carry signal in response to a masking signal, wherein a j-th scan stage among the plurality of scan stages i) receives a scan signal output from a (j−a)th scan stage as the carry signal when the (j−a)th scan stage is not one of the some scan stages, and ii) receives the masking carry signal output from a masking circuit corresponding to the (j−a)th scan stage as the carry signal when the (j−a)th scan stage is one of the some scan stages, wherein j is a natural number greater than 1, and a is a natural number less than j.

2. The driving circuit of claim 1, wherein the masking signal comprises a first masking signal and a second masking signal.

3. The driving circuit of claim 2, wherein each of the plurality of masking circuits outputs the scan signal output from the corresponding scan stage as the masking carry signal when the first masking signal has a first level and the second masking signal has a second level, and each of the plurality of masking circuits does not output the scan signal output from the corresponding scan stage as the masking carry signal when the first masking signal has the second level and the second masking signal has the first level.

4. The driving circuit of claim 2, wherein each of the plurality of masking circuits maintains the first voltage as the masking carry signal when the first masking signal has a second level and the second masking signal has a first level.

5. The driving circuit of claim 2, wherein each of the scan stages comprises:

an output terminal which outputs the scan signal; and a first voltage terminal which receives the first voltage, and each of the plurality of masking circuits comprises:

a first transistor connected between the output terminal of the corresponding scan stage and the carry output terminal and comprising a gate electrode connected to a first masking input terminal which receives the first masking signal; and a second transistor connected between the carry output terminal and the first voltage terminal of the corresponding scan stage and comprising a gate electrode connected to a second masking input terminal which receives the second masking signal.

6. A display device comprising:

a display panel comprising a plurality of data lines, a plurality of first scan lines, and a plurality of pixels connected to the data lines and the first scan lines;

a data driving circuit which drives the data lines;

a driving circuit comprising a first scan driving circuit which drives the first scan lines; and a driving controller which controls the data driving circuit and the driving circuit to drive a first display area of the display panel at a first driving frequency during a multi-frequency mode and to drive a second display area of the display panel at a second driving frequency during the multi-frequency mode, wherein the first scan driving circuit comprises a plurality of first scan stages each of which corresponds to the first scan lines, receives clock signals and a carry signal, and outputs a first scan signal, the driving circuit further comprises a plurality of masking circuits corresponding to some first scan stages, respectively, among the first scan stages, each of the masking circuits outputs through a carry output terminal one of i) the first scan signal output from a corresponding first scan stage and ii) a first voltage as a masking carry signal in response to a masking signal, a j-th first scan stage among the first scan stages i) receives a first scan signal output from a (j−a)th first scan stage as the carry signal when the (j−a)th first scan stage is not one of the some first scan stages, and ii) receives the masking carry signal output from a masking circuit corresponding to the (j−a)th first scan stage as the carry signal when the (j−a)th first scan stage is one of the some first scan stages, and wherein j is a natural number greater than 1, and a is a natural number less than j.

7. The display device of claim 6, wherein the masking circuit corresponds to a y-th first scan stage among the first scan stages and outputs the first scan signal output from the y-th first scan stage as a y-th carry signal in response to the masking signal, and a (y+a)th first scan stage among the first scan stages receives the y-th carry signal output from the corresponding masking circuit as the carry signal, and y is a natural number.

8. The display device of claim 6, wherein the masking signal comprises a first masking signal and a second masking signal.

9. The display device of claim 8, wherein each of the plurality of masking circuits outputs the first scan signal output from the corresponding first scan stage as the masking carry signal when the first masking signal has a first level and the second masking signal has a second level, and each of the plurality of masking circuits does not output the first scan signal output from the corresponding first scan stage as the masking carry signal when the first masking signal has the second level and the second masking signal has the first level.

10. The display device of claim 9, wherein each of the plurality of masking circuits maintains the first voltage as the masking carry signal when the first masking signal has the second level and the second masking signal has the first level.

11. The display device of claim 8, wherein each of the first scan stages comprises:

an output terminal which outputs the first scan signal; and a first voltage terminal which receives the first voltage, and each of the plurality of masking circuits comprises:

a first transistor connected between the output terminal of the corresponding first scan stage and the carry output terminal and comprising a gate electrode connected to a first masking input terminal which receives the first masking signal; and a second transistor connected between the carry output terminal and the first voltage terminal of the corresponding first scan stage and comprising a gate electrode connected to a second masking input terminal which receives the second masking signal.

12. The display device of claim 6, wherein the driving controller controls the data driving circuit and the first scan driving circuit to drive the first display area and the second display area at a predetermined frequency in a normal-frequency mode, and the second driving frequency is lower than the predetermined frequency.

13. The display device of claim 12, wherein the first driving frequency is higher than the predetermined frequency.

14. The display device of claim 6, wherein the driving circuit further comprises a second scan driving circuit, wherein the display panel further comprises a plurality of second scan lines connected to the plurality of pixels, respectively, and the second scan driving circuit comprises a plurality of second scan stages each of which corresponds to the second scan lines, receives the clock signals and the carry signal, and outputs a second scan signal.

15. The display device of claim 14, wherein the driving circuit further comprises a third scan driving circuit, wherein the display panel further comprises a plurality of third scan lines connected to the plurality of pixels, respectively, and the third scan driving circuit comprises a plurality of third scan stages each of which corresponds to the third scan lines, receives the clock signals and the carry signal, and outputs a third scan signal.

16. The display panel of claim 15, further comprising a light emitting driving circuit, wherein the display panel further comprises a plurality of light emitting control lines connected to the plurality of pixels, respectively, and the light emitting driving circuit comprises a plurality of light emitting stages each of which corresponds to the light emitting control lines, receives the clock signals and the carry signal, and outputs a light emitting control signal.

17. The display device of claim 16, wherein the first scan lines, the second scan lines, the third scan lines, and the light emitting control lines extend in a first direction and are arranged in a second direction to be spaced apart from each other.

18. The display device of claim 16, wherein each of the first scan stages, each of the second scan stages, and each of the light emitting stages have a same length in a second direction, and each of the first scan stages is two times greater in a length in the second direction than a length in the second direction of each of the third scan stages.

19. The display device of claim 16, wherein each of the first scan stages applies first scan signals that are substantially the same each other to pixels arranged in four rows among the plurality of pixels, and each of the light emitting stages applies light emitting control signals that are substantially the same as each other to pixels arranged in four rows among the plurality of pixels.

20. The display device of claim 16, wherein each of the second scan stages applies second scan signals that are substantially the same as each other to pixels arranged in two rows among the plurality of pixels, and each of the third scan stages applies third signals that are substantially the same as each other to pixels arranged in one row among the plurality of pixels.

* * * * *